US012631179B2

(12) United States Patent
Park et al.

(10) Patent No.: US 12,631,179 B2
(45) Date of Patent: May 19, 2026

(54) SCROLL COMPRESSOR

(71) Applicant: LG ELECTRONICS INC., Seoul (KR)

(72) Inventors: Junghoon Park, Seoul (KR); Sungyong Ahn, Seoul (KR); Taekyoung Kim, Seoul (KR); Seheon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/854,638

(22) PCT Filed: Jul. 25, 2022

(86) PCT No.: PCT/KR2022/010894
§ 371 (c)(1),
(2) Date: Oct. 7, 2024

(87) PCT Pub. No.: WO2023/204353
PCT Pub. Date: Oct. 26, 2023

(65) Prior Publication Data

US 2025/0354552 A1 Nov. 20, 2025

(30) Foreign Application Priority Data

Apr. 20, 2022 (KR) ..... 10-2022-0049011

(51) Int. Cl.
*F04C 18/02* (2006.01)
*F04C 29/00* (2006.01)
*F04C 29/12* (2006.01)

(52) U.S. Cl.
CPC ..... *F04C 18/0215* (2013.01); *F04C 29/00* (2013.01); *F04C 29/12* (2013.01)

(58) Field of Classification Search
CPC ..... F04C 18/0215; F04C 29/00; F04C 29/12; F04C 29/028; F04C 29/128; F04C 29/126; F04C 28/24; F04C 28/26
See application file for complete search history.

(56) References Cited

U.S. PATENT DOCUMENTS 9,945,378 B2 * 4/2018 Kouno ..... F04C 28/26
10,502,211 B2 * 12/2019 Nagahara ..... F04C 18/0215
(Continued)

FOREIGN PATENT DOCUMENTS

JP 2005-140016 6/2005
KR 10-2004-0019631 3/2004
(Continued)

OTHER PUBLICATIONS

International Search Report dated Jul. 19, 2023 issued in Application No. PCT/KR2022/010894.

*Primary Examiner* — Dapinder Singh
(74) *Attorney, Agent, or Firm* — KED & ASSOCIATES

(57) ABSTRACT

A scroll compressor is provided. The scroll compressor comprises: a first compression part comprising a first stationary scroll and a first orbiting scroll; and a second compression part comprising a second stationary scroll and a second orbiting scroll, wherein at least one of the first compression part and the second compression part may have a capacity variable part equipped therein so as to induce refrigerant discharge from a compression chamber or to induce idling by blocking refrigerant suction in the compression chamber. The above configuration facilitates varying the capacity of the compressor while significantly reducing the capacity variation ratio, thereby increasing the energy efficiency of the compressor and the air conditioner equipped therewith.

11 Claims, 14 Drawing Sheets

(56) References Cited

U.S. PATENT DOCUMENTS

| | | | | |
|---|---|---|---|---|
| 11,187,231 | B2 * | 11/2021 | Takashi | F04C 23/008 |
| 11,703,052 | B2 * | 7/2023 | Cho | F04C 29/126 418/55.1 |
| 2004/0126260 | A1 * | 7/2004 | Witham | F04C 18/0215 418/55.5 |
| 2006/0006598 | A1 * | 1/2006 | Kimura | F04C 18/0215 277/302 |
| 2020/0309126 | A1 * | 10/2020 | Hattori | F04C 28/24 |
| 2022/0381242 | A1 * | 12/2022 | Lee | F04C 29/124 |

FOREIGN PATENT DOCUMENTS

| | | |
|---|---|---|
| KR | 10-0480122 | 4/2005 |
| KR | 10-0585811 | 6/2006 |
| KR | 10-2011-0009257 | 1/2011 |
| KR | 10-2015-0006278 | 1/2015 |

* cited by examiner

SCROLL COMPRESSOR

CROSS-REFERENCE TO RELATED PATENT APPLICATIONS

This application is a U.S. National Stage Application under 35 U.S.C. § 371 of PCT Application No. PCT/KR2022/010894, filed Jul. 25, 2022, which claims priority to Korean Patent Application No. 10-2022-0049011, filed Apr. 20, 2022, whose entire disclosures are hereby incorporated by reference.

TECHNICAL FIELD

The present disclosure relates to a scroll compressor, and more particularly, a dual-stage scroll compressor.

BACKGROUND ART

In a scroll compressor, a fixed scroll (or non-orbiting scroll) and an orbiting scroll that configure a compression part are engaged with each other to define a pair of compression chambers. This scroll compressor has fewer components and can rotate at high speed because suction, compression, and discharge occur continuously while the orbiting scroll rotates. Additionally, since a torque required for compression is less changed and suction and compression are carried out continuously, less noise and vibration occur. For this reason, the scroll compressors are widely applied to air conditioners.

Scroll compressors may be classified into a constant-speed scroll compressor and a variable-speed scroll compressor depending on whether an operating speed of a drive motor is variable. Recently, as the severity of climate change has been highlighted, variable-speed scroll compressors that can reduce carbon emissions have been emerging significantly. Variable-speed scroll compressors are also called inverter-type scroll compressors. Compared to constant-speed scroll compressors, they can control a compression capacity while operating continuously, thereby improving efficiency loss due to startup delay. Hereinafter, the variable-speed scroll compressor will be described by being defined as a variable-capacity scroll compressor.

Patent Document 1 (Korean Patent Publication No. 10-2011-0009257) discloses one example of a variable-capacity scroll compressor. Patent Document 1 discloses a separate control device inside a casing to vary a compression capacity. In Patent Document 1, machining and assembling are made difficult due to a complicated structure of the control device, which causes an increase in manufacturing costs.

Patent Document 2 (Korean Patent Publication No. 10-2004-0019631) discloses another example of a variable-capacity scroll compressor. In Patent Document 2, separate piping and control device are disposed outside a casing. In Patent Document 2, due to the need for a complicated piping outside the casing, machining and assembling are made difficult, increasing manufacturing costs. In addition, in Patent Document 2, malfunction of the control device may occur and reliability may be reduced depending on a flow rate returned from a discharge side to a suction side.

Due to the nature of these variable-capacity scroll compressors according to the related art in addition to those patent documents, there was a limit to lowering a capacity variation ratio, which is defined as a capacity reduction amount for a power operation, even when a partial load operation (hereinafter, referred to as a saving operation) was performed. This may equally occur even in a low-speed and low-pressure ratio operation in which a compression ratio is 1.5 or less.

DISCLOSURE OF INVENTION

Technical Problem

One aspect of the present disclosure is to provide a scroll compressor that is capable of easily implementing a capacity varying device.

Another aspect of the present disclosure is to provide a scroll compressor that is capable of varying a compression capacity by using leakage between compression chambers.

Still another aspect of the present disclosure is to provide a scroll compressor that is capable of inducing leakage between compression chambers by adjusting back pressure.

Another aspect of the present disclosure is to provide a scroll compressor that is capable of increasing energy efficiency by lowering a capacity variation ratio.

Another aspect of the present disclosure is to provide a scroll compressor that is capable of lowering a capacity variation ratio to 50%.

Another aspect of the present disclosure is to provide a scroll compressor that is capable of lowering a capacity variation ratio to 50% even under low-speed and low-pressure ratio conditions.

Solution to Problem

In order to achieve those aspects and other advantageous of the subject matter disclosed herein, there is provided a scroll compressor that may include a casing, a rotation shaft, a first compression part, a second compression part, and a main frame. The rotation shaft may be coupled to a rotor of the drive motor, and include a first eccentric portion and a second eccentric portion that are spaced apart from each other in an axial direction. The first compression part may be coupled to the first eccentric portion of the rotation shaft to form a first compression chamber. The second compression part may be disposed on one axial side of the first compression part and coupled to the second eccentric portion of the rotation shaft to form a second compression chamber. A shaft receiving portion may be disposed between the first compression part and the second compression part such that the rotation shaft penetrates therethrough. At least one of the first compression part and the second compression part may include a capacity varying part configured to idle the corresponding compression part by inducing refrigerant leakage from a compression chamber or block refrigerant suction into the corresponding compression chamber. This may facilitate capacity variation of the compressor while significantly reducing a capacity variation ratio, thereby increasing energy efficiencies of the compressor and an air conditioner having the compressor.

As an example, the first compression part may include a first orbiting scroll configured to orbitally move while being axially supported with a first back pressure chamber defined together with a first side surface of the main frame, and a first fixed scroll engaged with the first orbiting scroll to form the first compression chamber. The second compression part may include a second orbiting scroll configured to orbitally move while being axially supported with a second back pressure chamber defined together with a second side surface of the main frame, and a second fixed scroll engaged with the second orbiting scroll to form the second compression chamber. The capacity varying part may include a communication hole and a first valve. The communication hole may be disposed in the first orbiting scroll such that the first compression chamber and the first back pressure chamber communicate with each other. The first valve may be disposed to open and close the communication hole to allow refrigerant movement from the first compression chamber to the first back pressure chamber while blocking refrigerant movement from the first back pressure chamber to the first compression chamber. Through this, depending on operating conditions of the compressor, refrigerant in a corresponding compression chamber may leak and back pressure may be reduced, resulting in idling the corresponding compression chamber.

Specifically, a first back pressure sealing member may be disposed between the first orbiting scroll and the first side surface of the main frame facing the first orbiting scroll to divide the first back pressure chamber into a first inner back pressure chamber and a first outer back pressure chamber. The communication hole may communicate with the first inner back pressure chamber. Through this, during a low-speed/low-pressure ratio operation, refrigerant in a corresponding compression chamber may leak and back pressure may be reduced, resulting in idling the corresponding compression chamber.

More specifically, the communication hole may include a valve receiving groove formed in an end portion thereof facing the main frame. The first valve may be slidably inserted into the valve receiving groove to open and close the communication hole. Through this, during a low-speed/low-pressure ratio operation, leakage of refrigerant in a corresponding compression chamber can be easily induced, thereby facilitating reduction of a capacity variation ratio for the corresponding compression chamber.

More specifically, a discharge guide groove may be formed by extending radially from an inner circumferential surface of the valve receiving groove. The refrigerant guide groove may extend in a direction toward a center of the rotation shaft. Through this, during a low-speed/low-pressure ratio operation, refrigerant in a corresponding compression chamber can quickly leak to a back pressure chamber, which has relatively low pressure, thereby quickly lowering a capacity variation ratio for the corresponding compression chamber.

Specifically, the first valve may be formed such that a cross-section on a side toward the main frame is smaller than a cross-section on a side toward the first orbiting scroll. Through this, when the compressor switches from a saving operation to a power operation, oil can be quickly introduced into a back pressure surface of the first valve, such that the first valve can be quickly moved in a closing direction to quickly block the communication hole.

As another example, a first suction port may be formed in the first compression part, and a second suction port may be formed in the second compression part. A first suction pipe may be connected to the first suction port, and a second suction pipe separated from the first suction pipe may be connected to the second suction port. The capacity varying part may include a second valve configured to selectively open and close the first suction pipe or the second suction pipe. Through this, depending on operating conditions of the compressor, a suction port of a corresponding compression chamber can be blocked to suppress refrigerant suction, thereby idling the corresponding compression chamber.

Specifically, a refrigerant suction pipe may be disposed outside the casing, the first suction pipe may be connected to a first position of the refrigerant suction pipe, and the second suction pipe may be connected to a second position of the refrigerant suction pipe. The second valve may be disposed in the refrigerant suction pipe to open and close the refrigerant suction pipe. The second valve may be disposed between the first position and the second position. Through this, a capacity varying apparatus can be simplified by installing the second valve, which opens and closes a suction port of a corresponding compression chamber, in the refrigerant suction pipe.

More specifically, the refrigerant suction pipe may include a valve seat surface between the first position and the second position. The second valve may be slidably inserted along the refrigerant suction pipe to be attached to and detached from the valve seat surface. Through this, the second valve that opens and closes a suction port of a corresponding compression chamber may operate quickly and smoothly, thereby increasing reliability.

More specifically, an elastic member may be disposed on one side surface of the second valve to support the second valve in a direction toward the valve seat surface. Through this, the second valve that opens and closes a suction port of a corresponding compression chamber may block a refrigerant suction passage more quickly and smoothly by elastic force of the elastic member.

In addition, the first compression part may include a first orbiting scroll configured to orbitally move while being axially supported with a first back pressure chamber defined together with a first side surface of the main frame, and a first fixed scroll engaged with the first orbiting scroll to form the first compression chamber. The second compression part may include a second orbiting scroll configured to orbitally move while being axially supported with a second back pressure chamber defined together with a second side surface of the main frame, a second fixed scroll engaged with the second orbiting scroll to form the second compression chamber. A pressurization passage may be disposed between the second back pressure chamber and the refrigerant suction pipe, to guide refrigerant in the second back pressure chamber toward a valve space defined by a back pressure surface of the second valve, such that the second valve is pressurized toward the second position. Through this, the second valve that opens or closes a suction port of a corresponding compression chamber may be quickly and smoothly blocked or open using back pressure supporting the orbiting scroll.

Specifically, the pressurization passage may include a pressurization hole and a connection pipe. The pressurization hole may be formed through the main frame. The connection pipe may have one end connected to the pressurization hole, and another end inserted through the casing to be connected to the refrigerant suction pipe. A third valve may be disposed in the pressurization hole to allow refrigerant movement from the second back pressure chamber to the valve space while blocking refrigerant movement from the valve space to the second back pressure chamber. Through this, the third valve, which opens and closes the pressurization hole connecting the back pressure chamber and the second valve, may be open and closed by a pressure difference, thereby enhancing operational reliability while simplifying the structure of the third valve.

More specifically, a second back pressure sealing member may be disposed between the second orbiting scroll and the second side surface of the main frame facing the second orbiting scroll to divide the second back pressure chamber into a second inner back pressure chamber and a second outer back pressure chamber. The pressurization hole may communicate with the second outer back pressure chamber. Through this, oil of intermediate pressure can be supplied to a back pressure surface of the second valve, which may allow the second valve to be quickly open during switching from a saving operation to a power operation, thereby suppressing an occurrence of an operation delay.

More specifically, the pressurization hole may include a first hole, a second hole, and a third hole. The first hole may be connected to the second outer back pressure chamber. The second hole may have one end connected to the first hole, and another end connected to the shaft receiving portion of the main frame. The third hole may have one end connected to a contact point between the first hole and the second hole, and another end connected to the connection pipe. The third valve may be slidable in the second hole to open and close a portion between the first hole and the third hole by a pressure difference between the first hole and the second hole. Through this, by forming the pressurization passage for connecting the back pressure chamber and the back pressure surface of the second valve in the main frame, the pressurization passage may be simplified and the operational reliability of the third valve may be enhanced.

As still another example, the first eccentric portion and the second eccentric portion may be formed so that a center of the first eccentric portion and a center of the second eccentric portion are located at different rotation angles in the axial direction. Accordingly, an eccentric load due to centrifugal force in the first orbiting scroll coupled to the first eccentric portion and an eccentric load by concentric force in the second orbiting scroll coupled to the second eccentric portion may be canceled by each other, thereby reducing vibration of the compressor.

Advantageous Effects of Invention

A scroll compressor according to the present disclosure may include a first compression part and a second compression part along an axial direction, and at least one of the first compression part and the second compression part may include a capacity varying part to induce refrigerant leakage from a compression chamber or block refrigerant suction into the compression chamber such that the compression chamber runs idle. Through this, the capacity of the compressor may be easily varied while a capacity variation ratio is significantly reduced, thereby increasing energy efficiencies of the compressor and an air conditioner having the compressor.

A scroll compressor according to the present disclosure may include a communication hole disposed in a first orbiting scroll to communicate between a first compression chamber and a first back pressure chamber, and a first valve disposed to open and close the communication hole to allow refrigerant movement from the first compression chamber to the first back pressure chamber while blocking refrigerant movement from the first back pressure chamber to the first compression chamber. Through this, depending on operating conditions of the compressor, refrigerant in a corresponding compression chamber may leak and back pressure may be reduced, thereby idling the corresponding compression chamber.

A scroll compressor according to the present disclosure may include a first back pressure sealing member that is disposed between the first orbiting scroll and a first side surface of the main frame facing the first orbiting scroll to divide the first back pressure chamber into a first inner back pressure chamber and a first outer back pressure chamber, and the communication hole may communicate with the first inner back pressure chamber. Through this, during a low-speed/low-pressure ratio operation, refrigerant in a corresponding compression chamber may leak and back pressure may be reduced, resulting in idling the corresponding compression chamber.

A scroll compressor according to the present disclosure may include a first suction pipe connected to a first suction port of the first compression part, a second suction pipe connected to a second suction port of the second compression part, and a second valve to selectively open and close the first suction pipe or the second suction pipe. Through this, depending on operating conditions of the compressor, a suction port of a corresponding compression chamber may be blocked to suppress refrigerant suction, thereby idling the corresponding compression chamber.

A scroll compressor according to the present disclosure may include an elastic member that supports the second valve in a direction toward a valve seat surface so that the second valve quickly blocks a suction port of a corresponding compression chamber. Through this, the second valve that opens and closes a suction port of a corresponding compression chamber may block a refrigerant suction passage more quickly and smoothly by elastic force of the elastic member.

A scroll compressor according to the present disclosure may include a pressurization passage connecting a second back pressure chamber and the refrigerant suction pipe to guide refrigerant in the second back pressure chamber to a valve space formed by a back pressure surface of the second valve, and a third valve disposed in the pressurization passage to open and close the pressurization passage. Through this, the second valve that opens or closes a suction port of a corresponding compression chamber may be quickly and smoothly blocked or open using back pressure supporting the orbiting scroll.

A scroll compressor according to the present disclosure may be configured such that a center of the first eccentric portion of the rotation shaft and a center of the second eccentric portion of the rotation shaft are located at different rotation angles in the axial direction. Accordingly, an eccentric load due to centrifugal force in the first orbiting scroll coupled to the first eccentric portion and an eccentric load by concentric force in the second orbiting scroll coupled to the second eccentric portion may be canceled by each other, thereby reducing vibration of the compressor.

BRIEF DESCRIPTION OF DRAWINGS

FIG. 2 is an exploded perspective view illustrating a compression part in

FIG. 1.

FIGS. 6 and 7 are cross-sectional views illustrating the operations of the capacity varying apparatus in FIG. 1, wherein FIG. 6 illustrates a power operation and FIG. 7 illustrates a saving operation.

FIGS. 9 and 10 are cross-sectional views illustrating the operations of the capacity varying apparatus in FIG. 8, wherein FIG. 9 illustrates a power operation and FIG. 10 illustrates a saving operation.

FIGS. 13 and 14 are cross-sectional views illustrating the operations of the capacity varying apparatus in FIG. 11, wherein FIG. 13 illustrates a power operation and FIG. 14 illustrates a saving operation.

MODE FOR THE INVENTION

Description will now be given in detail of a scroll compressor disclosed herein, with reference to the accompanying drawings. In the following description, a description of some components may be omitted to clarify features of the present disclosure.

In addition, the term "upper side" used in the following description refers to a direction away from a support surface for supporting a scroll compressor according to an implementation of the present disclosure, that is, a direction toward a drive part (motor part or drive motor) when viewed based on the drive part (motor part or drive motor) and a compression part. The term "lower side" refers to a direction toward the support surface, that is, a direction toward the compression part when viewed based on the drive part (motor part or drive motor) and the compression part.

The term "axial direction" used in the following description refers to a lengthwise (longitudinal) direction of a rotation shaft. The "axial direction" may be understood as an up and down (or vertical) direction. The term "radial direction" refers to a direction that intersects the rotation shaft.

In addition, in the following description, a hermetic scroll compressor in which a drive part (motor part or drive motor) and a compression part are disposed in a casing will be described as an example. However, the present disclosure may be applied equally to an open type compressor in which a drive part (motor part or drive motor) is disposed outside a casing and connected to a compression part disposed inside the casing.

In addition, a description will be given of a bottom-compression type scroll compressor in which a drive part (a motor part or a drive motor) and a compression part are disposed vertically in an axial direction and a compression part is located below the motor unit. However, the present disclosure may be applied equally to a horizontal scroll compressor in which a drive part (motor part or drive motor) and a compression part are disposed in left and right directions, as well as a top-compression type scroll compressor in which the compression part is located above the drive part (motor part or drive motor).

In addition, the following description will be given of a dual-stage scroll compressor in which two compression parts are arranged axially as an example. However, the present disclosure may also be applicable to a single-stage scroll compressor with a single compression part.

Figure 1:
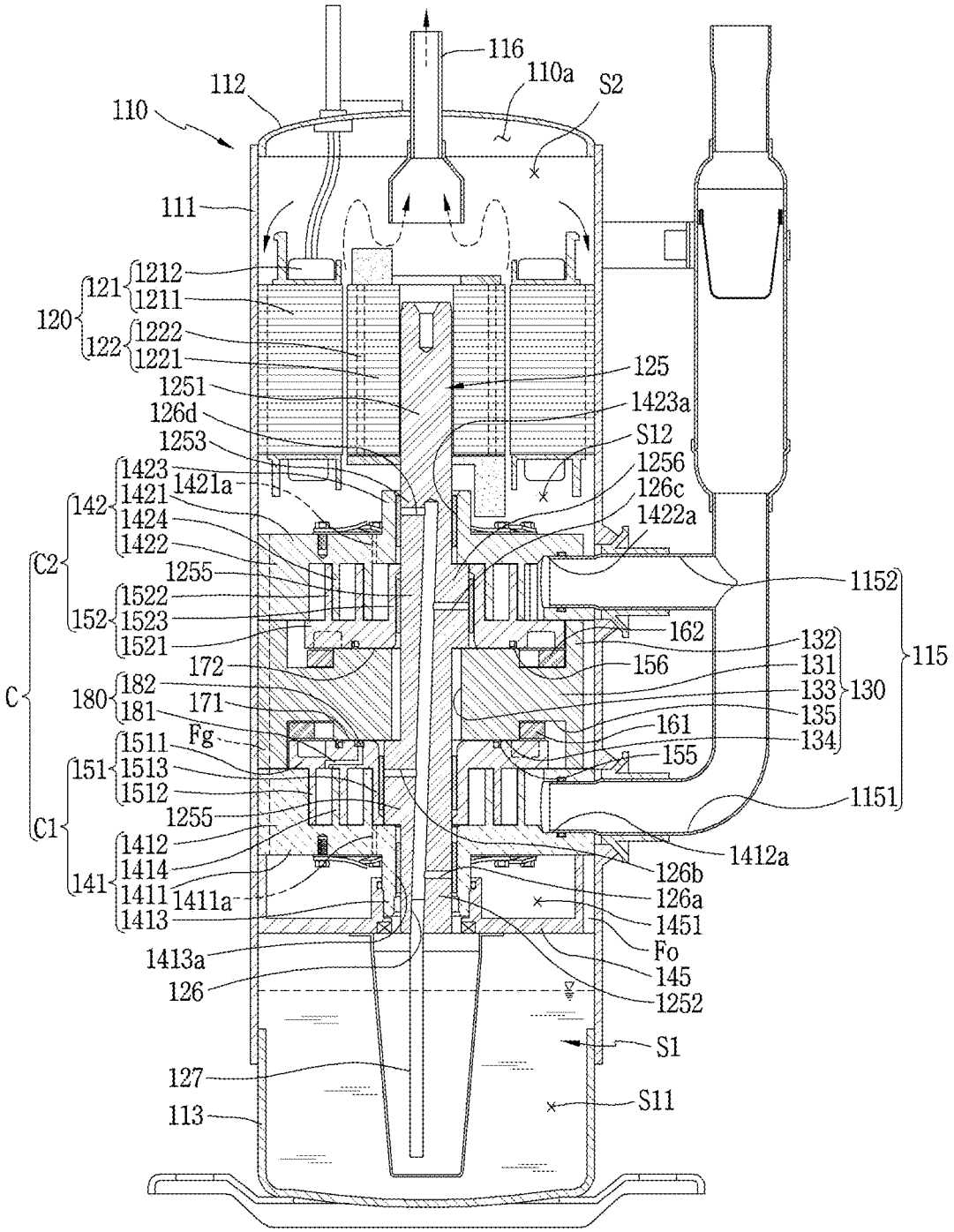
FIG. 1 is a longitudinal sectional view of a scroll compressor according to an embodiment of the present disclosure.
Figure 2:
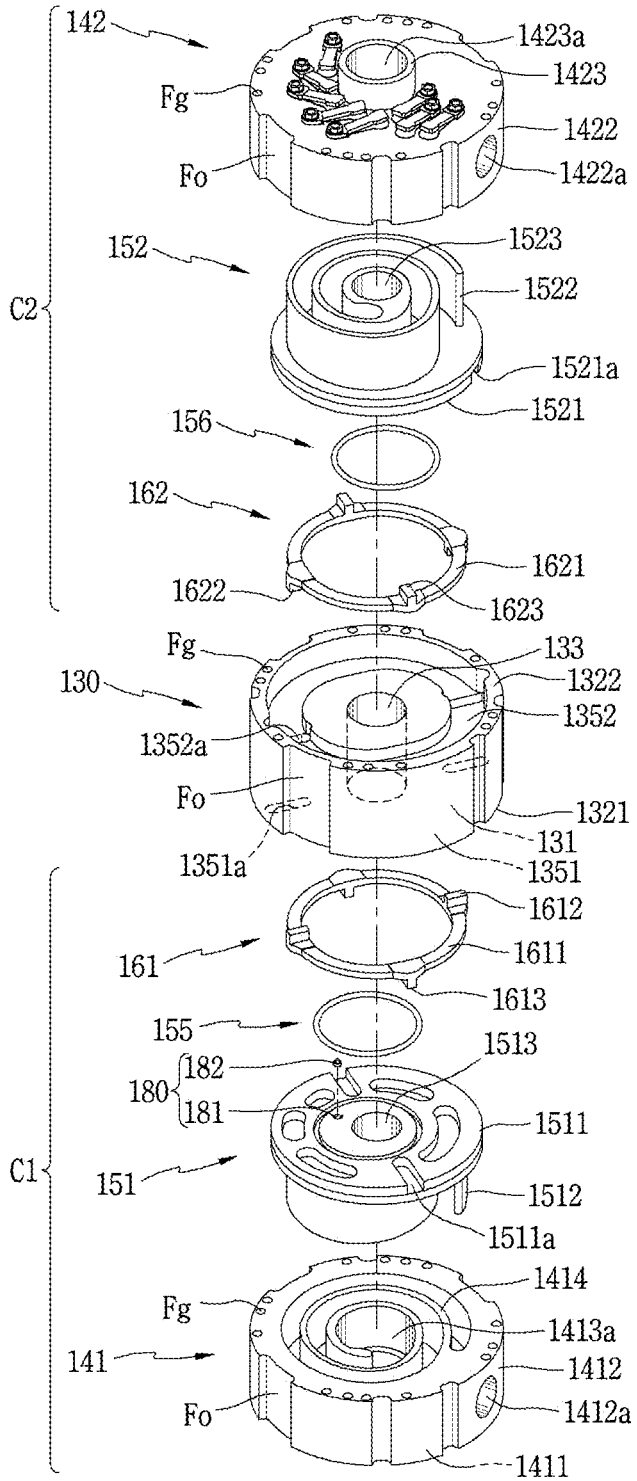

FIG. 1 is a longitudinal sectional view illustrating a scroll compressor in accordance with an embodiment of the present disclosure, and FIG. 2 is an exploded perspective view illustrating a compression part in FIG. 1.

Referring to FIG. 1, a dual-stage scroll compressor (hereinafter, abbreviated as a scroll compressor) according to an embodiment includes a drive motor 120 constituting a motor part disposed in an upper-half portion of a casing 110, and a first compression part C1 and a second compression part C2 on one side of the drive motor 120.

The drive motor 120 constituting the motor part is coupled to an upper end of a rotation shaft 125 to be described later, and the first compression part C1 and the second compression part C2 are sequentially coupled to a lower end of the rotation shaft 125. Accordingly, the compressor has the bottom-compression structure described above, and the first compression part C1 and the second compression part C2 are coupled to the drive motor 120 by the single rotation shaft 125 and operate at the same speed.

Referring to FIG. 1, the casing 110 according to an embodiment of the present disclosure may include a cylindrical shell 111, an upper shell 112, and a lower shell 113. The cylindrical shell 112 is formed in a cylindrical shape with upper and lower ends open. The upper shell 112 is coupled to cover the open upper end of the cylindrical shell 111. The lower shell 113 is coupled to cover the open lower end of the cylindrical shell 111. Accordingly, the inner space 110*a* of the casing 110 is sealed. The sealed inner space 110*a* of the casing 110 is divided into a lower space S1 and an upper space S2 based on the drive motor 120.

The lower space S1 may be a space defined below the drive motor 120. The lower space S1 may be further divided into an oil storage space S11 and an outflow passage S12 with respect to a compression part C including the first compression part C1 and the second compression part C2.

The oil storage space S11 is a space defined below the compression part C to store oil or mixed oil in which oil and liquid refrigerant are mixed. The outflow passage S12 is a space defined between an upper surface of the compression part C and a lower surface of the drive motor 120. Refrigerant compressed in the compression part C or mixed refrigerant in which oil is contained is discharged into the outflow passage S12.

The upper space S2 is a space defined above the drive motor 120 to form an oil-separating space in which oil is separated from refrigerant discharged from the compression part C. A refrigerant discharge pipe 116 communicates with the upper space S2.

The lower space S1 and the upper space S2 may communicate with each other through an internal passage penetrating the inner space 110*a* of the casing 110 or through an external passage penetrating the exterior of the casing 110. The embodiment according to the present disclosure illustrates an example in which the lower space S1 and the upper space S2 of the casing 110 communicate with each other through an internal passage. For example, the lower space S1 and the upper space S2 of the casing 110 may communicate with each other through an internal passage that continuously penetrates between an inner surface of the casing 110 and an outer surface of the drive motor 120 and between the inner surface of the casing 110 and an outer surface of the compression part C. The internal passage may be divided into a refrigerant discharge passage Fg and an oil return passage Fo. Accordingly, refrigerant discharged to the lower space S1 may move to the upper space S2 through the refrigerant discharge passage Fg, and oil separated from the refrigerant in the upper space S2 may return to the lower space S1 through the oil return passage Fo. Since this is known in the field of bottom-compression type scroll compressors, a detailed description thereof will be omitted.

A refrigerant suction pipe 115 is coupled through a side surface of the cylindrical shell 111. Accordingly, the refrigerant suction pipe 115 is coupled through the cylindrical shell 111 forming the casing 110 in a radial direction.

The refrigerant suction pipe 115 may be formed in an F-like shape having one inlet and two outlets. For example, one end of the refrigerant suction pipe 115 defining an inlet is connected to a refrigerant pipe (not illustrated) extending from an evaporator (not illustrated). The other end of the refrigerant suction pipe 115 defining an outlet is divided into a first suction pipe 1151 and a second suction pipe 1152. The first suction pipe 1151 is connected to a first suction port 1412*a* to be described later, and the second suction pipe 1152 is connected to a second suction port 1422*a* to be described later, respectively. Accordingly, refrigerant is directly suctioned into a first compression chamber V1 and a second compression chamber V2 through the first suction pipe 1151 and the second suction pipe 1152, respectively. The refrigerant suction pipe 115 will be described later again together with a capacity varying apparatus 180.

An inner end of the refrigerant discharge pipe 116 is coupled through an upper portion of the upper shell 112 to communicate with the inner space 110*a* of the casing 110, specifically, the upper space S2 defined above the drive motor 120.

One end portion of an oil circulation pipe (not illustrated) may be coupled through a lower-half portion of the lower shell 113 in the radial direction. Both ends of the oil circulation pipe may be open, and another end portion of the oil circulation pipe may be coupled through the refrigerant suction pipe 115. An oil circulation valve (not illustrated) may be installed in a middle portion of the oil circulation pipe.

Referring to FIG. 1, the drive motor 120 according to the embodiment includes a stator 121 and a rotor 122. The stator 121 is fitted onto the inner circumferential surface of the cylindrical shell 111, and the rotor 122 is rotatably disposed in the stator 121.

The stator 121 includes a stator core 1211 and a stator coil 1212.

The stator core 1211 is formed in an annular shape or a hollow cylindrical shape and is shrink-fitted onto the inner circumferential surface of the cylindrical shell 111. An outer circumferential surface of the stator core 1211 may be cut or recessed into a D-cut shape along an axial direction, such that oil separated from refrigerant in the upper space S2 can return to the oil storage space S11.

The stator coil 1212 is wound around the stator core 1211 and electrically connected to an external power source through a power cable 1141 that is coupled through the casing 110. A refrigerant passage (not illustrated) is formed between the stator core 1211 and the stator coil 1212 so that refrigerant discharged from the first compression part C1 moves to the upper space S2.

The rotor 122 includes a rotor core 1221 and permanent magnets 1222.

The rotor core 1221 is formed in a cylindrical shape, and is rotatably received in a central portion of the stator core 1211 with a preset gap therebetween. Accordingly, the gap between the stator core 1211 and the rotor core 1221 defines a refrigerant passage (reference numeral not given).

The permanent magnets 1222 are embedded along the edge of the rotor core 1221, and the upper end portion of the rotation shaft 125 is coupled to the center of the rotor core 1221. Accordingly, the rotation shaft 125 transmits rotational force of the drive motor 120 to a first orbiting scroll 151 and a second orbiting scroll 152, which define the compression part C, while rotating together with the rotor 122.

The rotation shaft 125 includes a main shaft portion 1251, a first bearing portion 1252, a second bearing portion 1253, an extension portion 1254, a first eccentric portion 1255, and a second eccentric portion 1256. The first bearing portion 1252, the second bearing portion 1253, and the shaft alignment portion 1254 are formed on the same axis as the main shaft portion 1251, and the first eccentric portion 1255 and the second eccentric portion 1256 are formed on a different axis from the main shaft portion 1251. Accordingly, when the rotation shaft 125 rotates, the first eccentric portion 1255 and the second eccentric portion 1256 rotate eccentrically around the axial center O of the rotation shaft 125.

The main shaft portion 1251 forms the upper end portion of the rotation shaft 125 and is press-fitted to the rotor 122. The main shaft portion 1251 extends axially to be located on the same axis as the rotor 122. Accordingly, the main shaft portion 1251 rotates concentrically with the rotor 122.

The first bearing portion 1252 is formed between the main shaft portion 1251 and the first eccentric portion 1255, and the second bearing portion 1253 is formed between the second eccentric portion 1256 and the lower end of the rotation shaft 125. Accordingly, the first bearing portion 1252 can be inserted into a first fixed scroll 141 to be described later and supported in a radial direction, and the second bearing portion 1253 can be inserted into a second fixed scroll 142 to be described later and supported in the radial direction.

The first eccentric portion 1255 and the second eccentric portion 1256 extend from the main shaft portion 1251 to define the lower-half portion of the rotation shaft 125, and are inserted to be coupled to the compression part. For example, the first eccentric portion 1255 is coupled to the first compression part C1 to be described later, and the second eccentric portion 1256 is coupled to the second compression part C2 to be described later. Accordingly, the first eccentric portion 1255 and the second eccentric portion 1256 rotate at the same speed as the main shaft portion 1251.

The first eccentric portion 1255 and the second eccentric portion 1256 may be formed on the same axis or on different axes. In other words, the first eccentric portion 1255 and the second eccentric portion 1256 may be formed to be eccentric by the same eccentricity at the same rotation angle, or may be formed to be eccentric by different eccentricities at different rotation angles. In the embodiment, the first eccentric portion 1255 and the second eccentric portion 1256 are formed on different axes, for example, with a phase difference of 180° to be diagonally symmetric to each other based on the shaft alignment portion 1254. Accordingly, an eccentric load due to centrifugal force in the first orbiting scroll 151 coupled to the first eccentric portion 1255 and an eccentric load by concentric force in the second orbiting scroll 152 coupled to the second eccentric portion 1256 can be canceled by each other, thereby reducing vibration of the compressor.

Additionally, an oil supply passage 126 is formed in a hollow shape inside the rotation shaft 125. The oil supply passage 126 may be formed through the rotation shaft 125 or grooved (recessed) into the rotation shaft 125 by a preset height. In this embodiment, the oil passage 126 may be grooved from a lower end of the rotation shaft 125 by a middle height, for example, up to the first bearing portion 1252. An oil pickup 127 for pumping oil filled in the oil storage space S11 may be coupled to the lower end of the rotation shaft 125. Accordingly, the oil filled in the oil storage space S11 can be suctioned to an upper end of the rotation shaft 125 through the oil pickup 127 and the oil supply passage 126 during the rotation of the rotation shaft 125, to lubricate a sliding part.

The oil supply passage 126 may be formed axially or inclined at a preset angle. The embodiment according to the present disclosure illustrates an example in which the oil supply passage 126 is inclined. Accordingly, oil pumped by the oil pickup 127 can be suctioned by concentric force in the oil supply passage 126, to be smoothly supplied to the sliding part.

The oil supply passage 126 is provided with an oil supply hole formed through the outer circumferential surface of the rotation shaft 125. The oil supply passage may be provided in plurality disposed with preset gaps between a lower end and an upper end of the oil supply passage 126. For example, a first oil supply hole 126*a* may be formed in the second bearing portion 1253, a second oil supply hole 126*b* may be formed in the second eccentric portion 1256, a third oil supply hole 126*c* may be formed in the first eccentric portion 1255, and a fourth oil supply hole 126*d* may be formed in the first bearing portion 1252. Accordingly, oil pumped through the oil supply passage 126 can be smoothly supplied to corresponding bearing surfaces through the oil supply holes.

Referring to FIGS. 1 and 2, the compression part C according to the embodiment of the present disclosure includes a first compression part C1 and a second compression part C2. The first compression part C1 and the second compression part C2 are disposed axially on both sides with the main frame 130 therebetween. Accordingly, it can be understood that the main frame 130 is included in the compression part C but is not included in the first compression part C1 and the second compression part C2. Hereinafter, a description will be given under assumption that a compression part located below the main frame 130 is defined as the first compression part C1 and a compression part located above the main frame 130 is defined as the second compression part C2.

The main frame 130 is formed in an annular shape and fixedly connected to the inner circumferential surface of the cylindrical shell 111. For example, the main frame 130 include a frame end plate portion 131, a frame side wall portion 132, a shaft receiving portion 133, a scroll supporting portion 134, and an Oldham ring receiving portion 135.

The frame end plate portion 131 is a portion that separates the first compression part C1 and the second compression part C2 from each other, and the frame end plate portion 131 is press-fitted to or welded on the inner circumferential surface of the cylindrical shell 111. The shaft receiving portion 133 through which the rotation shaft 125 is inserted is formed in the center of the frame end plate portion 131. The shaft receiving portion 133 is formed to be larger than an outer diameter of the first eccentric portion 1255 so that the first eccentric portion 1255 of the rotation shaft 125 can pass therethrough.

The frame side wall portion 132 is a portion where a first fixed scroll 141 and a second fixed scroll 142 to be described later are supported, and extends in a cylindrical shape to protrude from the edge of the frame end plate portion 131 by a preset height along a circumferential direction. Accordingly, the first fixed scroll 141 and the second fixed scroll 142 supported on the frame side wall portion 132 may form spaces together with a first scroll supporting portion 1341 and a second scroll supporting portion 1342 to be explained later, such that the first orbiting scroll 151 and the second orbiting scroll 152 can be inserted therein, respectively.

The frame side wall portion 132 includes a first frame side wall portion 1321 and a second frame side wall portion 1322. The first frame side wall portion 1321 and the second frame side wall portion 1322 are symmetrically formed. The first frame side wall portion 1321 extends from a first side surface (bottom surface) of the frame end plate portion 131 toward the first compression part C1, and the second frame side wall portion 1322 extends from a second side surface (top surface) of the frame end plate portion 131 toward the second compression part C2. Accordingly, the first fixed scroll 141, which will be described later, can be axially supported on the first frame side wall portion 1321, and the second fixed scroll 142, which will be described later, can be axially supported on the second frame side wall portion 1322.

The shaft receiving portion 133 is a portion through which the rotation shaft 125 penetrates, and is formed axially through the center of the frame end plate portion 131. An inner diameter of the shaft receiving portion 133 is formed to be larger than the outer diameter of the rotation shaft 125, more precisely, larger than the outer diameter of the first eccentric portion 1255 or the second eccentric portion 1256. Accordingly, the rotation shaft 125 that includes the first eccentric portion 1255 and the second eccentric portion 1256 can be coupled through the shaft receiving portion 133.

The scroll supporting portion 134 is a portion where the first orbiting scroll 151 and the second orbiting scroll 152, which will be described later, are supported in the axial direction, and is formed flat between the frame side wall portion 132 and the shaft receiving portion 133. The scroll supporting portion 134 is formed lower than the frame side wall portion 132 to form spaces together with the first fixed scroll 141 and the second fixed scroll 142, such that the first orbiting scroll 151 and the second orbiting scroll 152 can be received therein.

The scroll supporting portion 134 includes a first scroll supporting portion 1341 and a second scroll supporting portion 1342. The first scroll supporting portion 1341 and the second scroll supporting portion 1342 are formed symmetrically. The first orbiting scroll 151, which will be described later, is axially supported on the first scroll supporting portion 1341, and the second orbiting scroll 152, which will be described later, is axially supported on the second scroll supporting portion 1342.

The Oldham ring receiving portion 135 is a portion into which the Oldham ring 161, 162, which is a rotation suppressing mechanism of the orbiting scroll 151, 152, is rotatably inserted, and is formed between the inner circumferential surface of the frame side wall portion 132 and the outer circumferential surface of the scroll supporting portion 134. Accordingly, the Oldham ring receiving portion 135 may be formed as a groove which is lower than the scroll supporting portion 134.

The Oldham ring receiving portion 135 include a first Oldham ring receiving portion 1351 and a second Oldham ring receiving portion 1352. The first Oldham ring receiving portion 1351 and the second Oldham ring receiving portion 1352 are formed symmetrically. A first Oldham ring 161 to be explained later is received in the first Oldham ring receiving portion 1351 to be coupled between the first side surface (bottom surface) of the main frame 130 and the first orbiting scroll 151, and a second Oldham ring 162 to be explained later is received in the second Oldham ring receiving portion 1352 to be coupled between the second side surface (top surface) of the main frame 130 and the second orbiting scroll 152.

A first fixing key groove 1351*a* is formed in the first Oldham ring receiving portion 1351*a*, and a second fixing key groove 1352*a* is formed in the second Oldham ring receiving portion 1352. A portion of the first fixing key groove 1351*a* extends up to the inner circumferential surface of the first frame side wall portion 1321, and a portion of the second fixing key groove 1352*a* extends up to the inner circumferential surface of the second frame side wall portion 1322.

A first fixing key 1612 of the first Oldham ring 161 to be explained later is slidably inserted into the first fixing key groove 1351*a*, and the second fixing key 1622 of the second Oldham ring 162 to be explained later is slidably inserted into the second fixing key groove 1352*a*. Accordingly, the first orbiting scroll 151 slidably pivots in an axially-supported state in the first scroll supporting portion 1341, and the second orbiting scroll 152 slidably pivots in an axially-supported state in the second scroll supporting portion 1342.

Referring to FIGS. 1 and 2, the first compression part C1 according to the embodiment of the present disclosure is provided below the main frame 130, and the first compression part C1 includes a first fixed scroll 141 and a first orbiting scroll 151.

The first fixed scroll 141 may be fixedly supported on the first side surface (bottom surface) of the main frame 130, more precisely, on the first frame side wall portion 1321 in the axial direction, and the first orbiting scroll 151 may be axially supported to be rotatable on the first side surface of the main frame 130, more precisely, on the first scroll supporting portion 1341 in a first space between the first scroll supporting portion 1341 and the first fixed scroll 141 facing the first scroll supporting portion 1341. Accordingly, a pair of first compression chambers V1 are formed between the first fixed scroll 141 and the first orbiting scroll 151 which define the first compression part C1.

The first fixed scroll 141 according to the embodiment of the present disclosure may include a first fixed end plate portion 1411, a first fixed side wall portion 1412, a first bearing protrusion portion 1413, and a first fixed wrap 1414.

The first fixed end plate portion 1411 is formed in a disk shape, and a first bearing hole 1413*a* forming the first bearing protrusion portion 1413 to be explained later is formed axially through the center of the first fixed end plate portion 1411. The first bearing hole 1413*a* is formed on the same axis as the shaft receiving portion 133 of the main frame 130. A bearing member made of a bushing bearing or a ball bearing is disposed on an inner circumferential surface of the first bearing hole 1413*a* to support the first bearing portion 1252 of the rotation shaft 125.

A first discharge port 1411*a* is formed adjacent to the first bearing hole 1413*a*, to be open toward a discharge space 1451 of a discharge cover 145, which is fixed to a second side surface (bottom surface) of the first fixed end plate portion 1411. Accordingly, refrigerant compressed in the first compression chamber V1 is discharged into the discharge space 1451 of the discharge cover 145 through the first discharge port 1411*a*.

The first fixed side wall portion 1412 may be formed in an annular shape by extending axially from the edge of a first side surface (top surface) of the first fixed end plate portion 1411 toward the first scroll side wall portion 1321 of the main frame 130. The first fixed side wall portion 1412 may be coupled to face the first frame side wall portion 1321 in the axial direction.

A first suction port 1421 is formed through the first fixed side wall portion 1412 in the radial direction. An end portion of the first suction pipe 1151 inserted through the cylindrical shell 111 described above is inserted into the first suction port 1421. Accordingly, a portion of refrigerant discharged from the evaporator is suctioned into the first compression chamber V1 through the first suction pipe 1151 of the refrigerant suction pipe 115 and a first suction port 1421*a*.

The first bearing protrusion portion 1413 axially extends from a central portion of the fixed end plate portion 1411 toward the lower shell 113. The first bearing hole 1413*a* having a cylindrical shape may be formed through a center of the first bearing protrusion portion 1 1413 in the axial direction, and the first bearing portion 1252 of the rotation shaft 125 may be inserted into the first bearing hole 1413*a* to be supported in the radial direction.

The first fixed wrap 1414 may extend from the upper surface of the first fixed end plate portion 1411 toward the first orbiting scroll 151 in the axial direction. The first fixed wrap 1414 is engaged with the first orbiting wrap 1512, which will be described later, to form a pair of first compression chambers V1.

The first fixed wrap 1414 may be formed in an involute shape. However, the first fixed wrap 1414 and the first orbiting wrap 1512 may be formed in various shapes other than the involute shape. For example, the first fixed wrap 1414 may be formed in a substantially elliptical shape in which a plurality of arcs having different diameters and origins are connected and the outermost curve has a major axis and a minor axis. The first orbiting wrap 1512 may be formed in a similar manner.

Referring to FIGS. 1 and 2, the first orbiting scroll 151 according to the embodiment of the present disclosure includes a first orbiting end plate portion 1511, a first orbiting wrap 1512, and a first rotation shaft coupling portion 1513.

The first orbiting end plate portion 1511 is formed in a disk shape and accommodated in a first space between the main frame 130 and the first fixed scroll 141. In other words, a first side surface (top surface) of the first orbiting end plate portion 1511 may be axially supported on the first side surface of the main frame 130, that is, the first scroll supporting portion 1341.

First orbiting key grooves 1511*a* are formed on both sides in an edge of the first side surface (top surface) of the first orbiting end plate portion 1511. First orbiting keys 1613 of the first Oldham ring 161 to be explained later are slid into the first orbiting key grooves 1511*a*. The first orbiting scroll 151 slidably performs an orbital motion in an axially-supported state on the first scroll supporting portion 1341 of the main frame 130.

In addition, a first back pressure sealing member 155 is disposed between the first orbiting end plate portion 1511 and the first scroll supporting portion 1341 facing it. For example, a first sealing groove (reference numeral not assigned) may be formed in an annular shape in the first orbiting end plate portion 1511, and the first back pressure sealing member 155 may be inserted into the first sealing groove. The first back pressure sealing member 155 is formed in an annular shape and surrounds the first bearing hole 1413*a*, but the first back pressure sealing member 155 may be eccentric with respect to the axial center O of the rotation shaft 125. Accordingly, a first space between the first orbiting end plate portion 1511 and the first scroll supporting portion 1341 facing it forms a first back pressure chamber 171. The first back pressure chamber 171 is formed such that an inner space with respect to the first back pressure sealing member 155 forms a first inner back pressure chamber 171*a* and an outer space forms a first outer back pressure chamber 171*b*.

In addition, the first back pressure chamber 171 communicates with the oil supply passage forming discharge pressure and the first bearing hole 1413*a*, such that the first inner back pressure chamber 171*a* forms a discharge pressure space and the first outer back pressure chamber 171*b* forms an intermediate pressure space, with the first back pressure sealing member 155 interposed therebetween. The first back pressure chamber 171 will be described later again together with a capacity varying apparatus 180.

The first orbiting wrap 1512 may extend from a second side surface (bottom surface) of the first orbiting end plate portion 1511 toward the first fixed scroll 141. The first orbiting wrap 1512 is engaged with the first fixed wrap 1414, to form the first compression chamber V1.

Since the orbiting wrap 1512 has a shape corresponding to the shape of the first fixed wrap 1414 described above, a description of the first orbiting wrap 1512 will be replaced with the description of the first fixed wrap 1414. However, an inner end portion of the first orbiting wrap 1512 may be formed at a central portion of the first orbiting end plate portion 1511, and the first rotation shaft coupling portion 1513 may be formed axially through the central portion of the first orbiting end plate portion 1511.

The first eccentric portion 1255 of the rotation shaft 125 may be rotatably inserted into the first rotation shaft coupling portion 1513. An outer circumferential portion of the first rotation shaft coupling portion 1513 is connected to the first orbiting wrap 1512 to form the first compression chamber V1 together with the first fixed wrap 1414 during a compression process.

The first rotation shaft coupling portion 1513 may be formed at a height at which it overlaps the first orbiting wrap 1512 on the same plane. That is, the first rotation shaft coupling portion 1513 may be disposed at a height at which the first eccentric portion 1255 of the rotation shaft 125 overlaps the first orbiting wrap 1512 on the same plane. Accordingly, repulsive force and compressive force of refrigerant can cancel each other while being applied to the same plane based on the first orbiting end plate portion 1511, and thus inclination of the first orbiting scroll 151 due to the interaction between the compressive force and the repulsive force can be suppressed.

As described above, the first Oldham ring 161 is disposed between the main frame 130 and the first orbiting scroll 151 facing it. Accordingly, the first orbiting scroll 151 performs an orbital motion with respect to the main frame 130 by the first Oldham ring 161.

The first Oldham ring 161 includes a first ring body 1611, a first fixing key 1612, and a first orbiting key 1613. The first ring body 1611 is inserted into the first Oldham ring receiving portion 1351, the first fixing key 1612 is slidably inserted into the first fixing key groove 1351*a* of the main frame 130, and the first orbiting key 1613 is slidably inserted into the first orbiting key groove 1511*a* of the first orbiting scroll 151. The first Oldham ring 161 is identical to the commonly known Oldham ring, so a detailed description thereof will be omitted.

Although not shown in the drawing, the first compression part C1 may include a first oil supply portion (not shown) that communicates with the oil supply passage 126 of the rotation shaft 125 and supplies oil to the first compression chamber V1. The first oil supply portion may be formed in the main frame 130, in the first fixed scroll 141, or in the first orbiting scroll 151. For example, when the first oil supply portion is formed in the first fixed scroll 141, the first oil supply portion may extend radially from the inner circumferential surface of the first bearing hole 1413*a* of the first fixed scroll 141 to communicate with the first compression chamber (intermediate pressure chamber). Accordingly, a portion of oil supplied to the first bearing portion 1252 through the oil supply passage 126 can be supplied to the first compression chamber V1 through the first oil supply portion.

Additionally, the first oil supply portion may be formed to be connected to two or more of the aforementioned members. For example, the first oil supply portion may be formed to communicate with the first Oldham ring receiving portion 1351 on the inner circumferential surface of the shaft receiving portion 133 of the main frame 130, and to communicate with the first compression chamber (intermediate pressure chamber) V1 through the first fixed side wall portion 1412 and the first fixed end plate portion 1411 in the first Oldham ring receiving portion 1351. Accordingly, a portion of oil supplied to the first bearing portion 1252 through the oil supply passage 126 can also be supplied to the first compression chamber V1 through the first oil supply portion.

Referring to FIGS. 1 and 2, the second compression part C2 according to the embodiment of the present disclosure is provided above the main frame 130, and the second compression part C2 is formed to be symmetrical to the first compression part C1. For example, the second compression part C2 includes a second fixed scroll 142 and a second orbiting scroll 152.

The second fixed scroll 142 may be fixedly supported on the second side surface (top surface) of the main frame 130 in the axial direction, and the second orbiting scroll 152 may be axially supported to be rotatable on the second scroll supporting portion 1341 of the main frame 130 in a second space between the second side surface of the main frame 130 and the second fixed scroll 142 facing it. Accordingly, a pair of second compression chambers V2 are formed between the second fixed scroll 142 and the second orbiting scroll 152 which define the second compression part C2.

The second fixed scroll 142 according to the embodiment of the present disclosure may include a second fixed end plate portion 1421, a second fixed side wall portion 1422, a second bearing protrusion portion 1423, and a second fixed wrap 1424.

The second fixed end plate portion 1421 is formed in a disk shape, and a second bearing hole 1423*a* forming the second bearing protrusion portion 1423 to be explained later is formed axially through the center of the second fixed end plate portion 1411. The second bearing hole 1423*a* is formed on the same axis as the shaft receiving portion 133 of the main frame 130 and the first bearing hole 1413*a*. A bearing member made of a bushing bearing or a ball bearing is disposed on an inner circumferential surface of the second bearing hole 1423*a* to support the second bearing portion 1253 of the rotation shaft 125.

A second discharge port 1421*a* is formed adjacent to the second bearing hole 1423*a*. The second discharge port 1421*a* is formed such that the second compression chamber V2 and the inner space 110*a* of the casing 110 communicate with each other therethrough. Accordingly, refrigerant compressed in the second compression chamber V2 is discharged into the inner space 110*a* of the casing 110 through the second discharge port 1421*a*.

The second fixed side wall portion 1422 may be formed in an annular shape by extending axially from the edge of a first side surface (bottom surface) of the second fixed end plate portion 1421 toward the second scroll side wall portion 1322 of the main frame 130. The second fixed side wall portion 1422 may be coupled to face the second frame side wall portion 1322 in the axial direction.

A second suction port 1422*a* is formed through the second fixed side wall portion 1422 in the radial direction. An end portion of the second suction pipe 1152 inserted through the cylindrical shell 111 described above is inserted into the second suction port 1422*a*. Accordingly, a portion of refrigerant discharged from the evaporator is suctioned into the second compression chamber V2 through the second suction pipe 1152 of the refrigerant suction pipe 115 and the second suction port 1422*a*.

The second bearing protrusion portion 1423 may axially extend from a central portion of the second fixed end plate portion 1421 toward the drive motor 120. A second bearing hole 1423*a* having a cylindrical shape may be formed through a center of the second bearing protrusion portion 2 1423 in the axial direction, and the second bearing portion 1253 of the rotation shaft 125 may be inserted into the second bearing hole 1423*a* to be supported in the radial direction.

The second fixed wrap 1424 may extend from the upper surface of the second fixed end plate portion 1421 toward the second orbiting scroll 152 in the axial direction. The second fixed wrap 1424 is engaged with the second orbiting wrap 1522 to be described later, to form a pair of second compression chambers V2.

The second fixed wrap 1424 may be formed in an involute shape. However, the second fixed wrap 1424 and the second orbiting wrap 1522 may be formed in various shapes other than the involute shape. For example, the second fixed wrap 1424 may be formed in a substantially elliptical shape in which a plurality of arcs having different diameters and origins are connected and the outermost curve has a major axis and a minor axis. The second orbiting wrap 1522 may be formed in a similar manner.

Referring to FIGS. 1 and 2, the second orbiting scroll 152 according to the embodiment of the present disclosure includes a second orbiting end plate portion 1521, a second orbiting wrap 1522, and a second rotation shaft coupling portion 1523.

The second orbiting end plate portion 1521 is formed in a disk shape and accommodated in a second space between the main frame 130 and the second fixed scroll 142. In other words, a first side surface (bottom surface) of the second orbiting end plate portion 1521 may be axially supported on the second side surface of the main frame 130, that is, the second scroll supporting portion 1342.

Second orbiting key grooves 1521*a* are formed on both sides in an edge of the first side surface of the second orbiting end plate portion 1521. Second orbiting keys 1623 of the second Oldham ring 162 to be explained later are slid into the first orbiting key grooves 1521*a*. The second orbiting scroll 152 may slidably perform an orbital motion in an axially-supported state on the second scroll supporting portion 1342.

In addition, a second back pressure sealing member 156 is disposed between the second orbiting end plate portion 1521 and the second scroll supporting portion 1342 facing it. For example, a second sealing groove (reference numeral not assigned) may be formed in an annular shape in the second orbiting end plate portion 1521, and the second back pressure sealing member 156 may be inserted into the second sealing groove. The second back pressure sealing member 156 is formed in an annular shape and surrounds the second bearing hole 1423*a*, but the second back pressure sealing member 156 may be eccentric with respect to the axial center O of the rotation shaft 125. Accordingly, a second space between the second orbiting end plate portion 1521 and the second scroll supporting portion 1342 facing it forms a second back pressure chamber 172. The second back pressure chamber 172 is formed such that an inner space with respect to the second back pressure sealing member 156 forms a second inner back pressure chamber 172*a* and an outer space forms a second outer back pressure chamber 172*b*.

In addition, the second back pressure chamber 172 communicates with the oil supply passage forming discharge pressure and the second bearing hole 1423*a*, such that the second inner back pressure chamber 172*a* forms a discharge pressure space and the second outer back pressure chamber 172*b* forms an intermediate pressure space, with the second back pressure sealing member 156 interposed therebetween.

The second orbiting wrap 1522 may extend from a second side surface (top surface) of the second orbiting end plate portion 1521 toward the first fixed scroll 141. The second orbiting wrap 1522 is engaged with the second fixed wrap 1424, to form the second compression chamber V2.

Since the second orbiting wrap 1522 has a shape corresponding to the shape of the second fixed wrap 1424 described above, a description of the second orbiting wrap 1522 will be replaced with the description of the second fixed wrap 1424. However, an inner end portion of the second orbiting wrap 1522 may be formed at a central portion of the second orbiting end plate portion 1521, and the second rotation shaft coupling portion 1523 may be formed axially through the central portion of the second orbiting end plate portion 1521.

The second eccentric portion 1256 of the rotation shaft 125 may be rotatably inserted into the second rotation shaft coupling portion 1523. An outer circumferential portion of the second rotation shaft coupling portion 1523 is connected to the second orbiting wrap 1522 to form the second compression chamber V2 together with the second fixed wrap 1424 during a compression process.

The second rotation shaft coupling portion 1523 may be formed at a height at which it overlaps the second orbiting wrap 1522 on the same plane. That is, the second rotation shaft coupling portion 1523 may be disposed at a height at which the second eccentric portion 1256 of the rotation shaft 125 overlaps the second orbiting wrap 1522 on the same plane. Accordingly, repulsive force and compressive force of refrigerant can cancel each other while being applied to the same plane based on the second orbiting end plate portion 1521, and thus inclination of the second orbiting scroll 152 due to the interaction between the compressive force and the repulsive force can be suppressed.

As described above, the second Oldham ring 162 is disposed between the main frame 130 and the second orbiting scroll 152 facing it. Accordingly, the second orbiting scroll 152 performs an orbital motion with respect to the main frame 130 by the second Oldham ring 162.

The second Oldham ring 162 includes a second ring body 1621, a second fixing key 1622, and a second orbiting key 1623. The second ring body is inserted into the second Oldham ring receiving portion 1352, the second fixing key is slidably inserted into the second fixing key groove of the main frame 130, and the second orbiting key is slidably inserted into the second orbiting key groove of the second orbiting scroll 152. The second Oldham ring 162 is identical to the commonly known Oldham ring, similar to the first Oldham ring 161, so a detailed description thereof will be omitted.

Although not shown in the drawing, the second compression part C2 may include a second oil supply portion (not shown) that communicates with the oil supply passage 126 of the rotation shaft 125 and supplies oil to the second compression chamber V2. The second oil supply portion may be formed in the main frame 130, in the second fixed scroll 142, or in the second orbiting scroll 152. For example, when the second oil supply portion is formed in the second fixed scroll 142, the second oil supply portion may extend radially from the inner circumferential surface of the second bearing hole 1423*a* of the second fixed scroll 142 to communicate with the second compression chamber (intermediate pressure chamber) V2. Accordingly, a portion of oil supplied to the second bearing portion 1253 through the oil supply passage 126 can be supplied to the second compression chamber V2 through the second oil supply portion.

Additionally, the second oil supply portion may be formed to be connected to two or more of the aforementioned members. For example, the second oil supply portion may be formed to communicate with the second Oldham ring receiving portion 1352 on the inner circumferential surface of the shaft receiving portion 133 of the main frame 130, and to communicate with the second compression chamber (intermediate pressure chamber) V2 through the second fixed side wall portion 1422 and the second fixed end plate portion 1421 in the second Oldham ring receiving portion 1352. Accordingly, a portion of oil supplied to the second bearing portion 1253 through the oil supply passage can be supplied to the second compression chamber V2 through the second oil supply portion.

The scroll compressor according to the embodiment of the present disclosure may operate as follows.

That is, when power is applied to the drive motor 120, rotational force is generated in the rotor 122 and the rotor 122 rotates. Then, the rotation shaft 125 coupled to the rotor 122 rotates, and the first orbiting scroll 151 coupled to the first eccentric portion 1255 of the rotation shaft 125 performs an orbital motion relative to the first fixed scroll 141 by the first Oldham ring 161, and at the same time, the second orbiting scroll 152 coupled to the second eccentric portion 1256 of the rotation shaft 125 performs an orbital motion relative respect to the second fixed scroll 142 by the second Oldham ring 162.

Then, volumes of the first compression chamber V1 and the second compression chamber V2 gradually decrease toward the intermediate pressure chambers and the discharge chambers, which are continuously formed toward a center from the suction pressure chambers, which are formed outside the corresponding compression chambers V1 and V2.

Then, refrigerant that has passed through a refrigeration cycle device is suctioned into a first suction pressure chamber forming the first compression chamber V1 through the first suction pipe 1151 of the refrigerant suction pipe 115, and into a second suction pressure chamber forming the second compression chamber V2 through the second suction pipe 1152.

Then, the refrigerants suctioned into the corresponding suction pressure chambers are compressed while moving to the corresponding discharge pressure chambers via the corresponding intermediate pressure chambers along movement trajectories of the first compression chamber V1 and the second compression chamber V2. The refrigerant compressed in the first compression chamber V1 is discharged to the discharge space 1451 of the discharge cover 145 through the first discharge port 1411*a* and the refrigerant compressed in the second compression chamber V2 is discharged to the inner space 110*a* of the casing 110 through the second discharge port 1421*a*.

Then, the refrigerant discharged from the first compression chamber V1 to the discharge space 1451 of the discharge cover 145 is guided to the discharge space S12 between the drive motor 120 and the compression part C through a refrigerant discharge passage Fg defined in the first fixed scroll 141, the main frame 130, and the second fixed scroll 142. This refrigerant is mixed with the refrigerant discharged from the second compression chamber V2 into the inner space 110*a* of the casing 110, flows through the drive motor 120, and is separated from oil in the upper space S2. Then, the refrigerant moves toward a condenser of the refrigeration cycle through the refrigerant discharge pipe 116 while oil separated from the refrigerant in the upper space S2 is recovered to the oil storage space S11, which is the lower space S1 of the casing 110, through an oil return passage Fo between the casing 110 and the stator 121 and between the casing 110 and the compression part C. The oil is thusly supplied to each bearing surface (not illustrated) through the oil supply passage 126, and partially supplied into the compression chamber V. This series of processes are repetitively performed.

Meanwhile, as described above, the scroll compressor according to the embodiment of the present disclosure may include a capacity varying apparatus 180 which performs a power operation or a saving operation depending on a required capacity of an air conditioner. However, in the related art scroll compressor including the capacity varying apparatus, it was failed to sufficiently lower a capacity variation ratio for the compressor, and in some cases, more cooling power than necessary was generated, causing an energy loss. This may cause excessive power consumption under low-speed and low-pressure ratio operating conditions with a pressure ratio of 1.5 or less, thereby lowering efficiency of an air conditioner.

Accordingly, in the embodiment according to the present disclosure, during a saving operation, one of the first compression part C1 and the second compression part C2 may run idle to allow the capacity variation ratio to reach 50% or less than 50%, thereby achieving appropriate cooling and/or heating capability. Hereinafter, a description will be focused on an example in which the capacity varying apparatus is disposed in the first compression part C1, but it is not necessarily limited to the case in which the capacity varying apparatus is disposed in the first compression part C1. For example, the capacity varying apparatus 180 may alternatively be installed in the second compression part C2, and in some cases, may be installed in each of the first compression part C1 and the second compression part C2.

Figure 3:
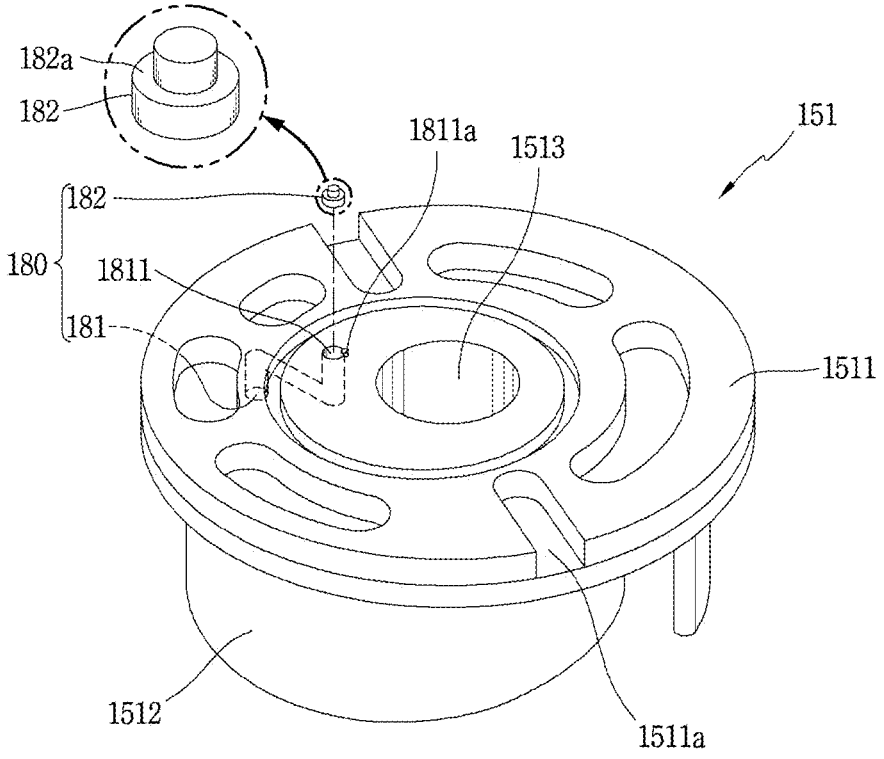
FIG. 3 is an exploded perspective view illustrating a capacity varying apparatus in FIG. 2.
Figure 4:
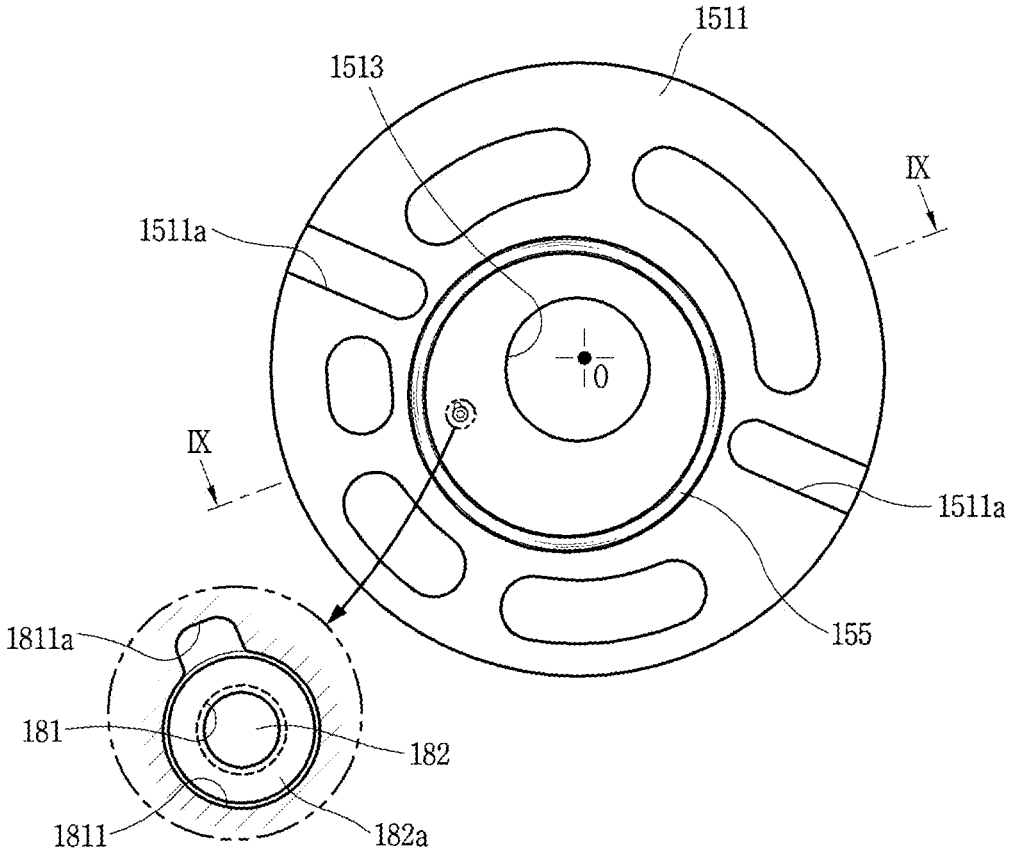
FIG. 4 is an assembled planar view of FIG. 3.
Figure 5:
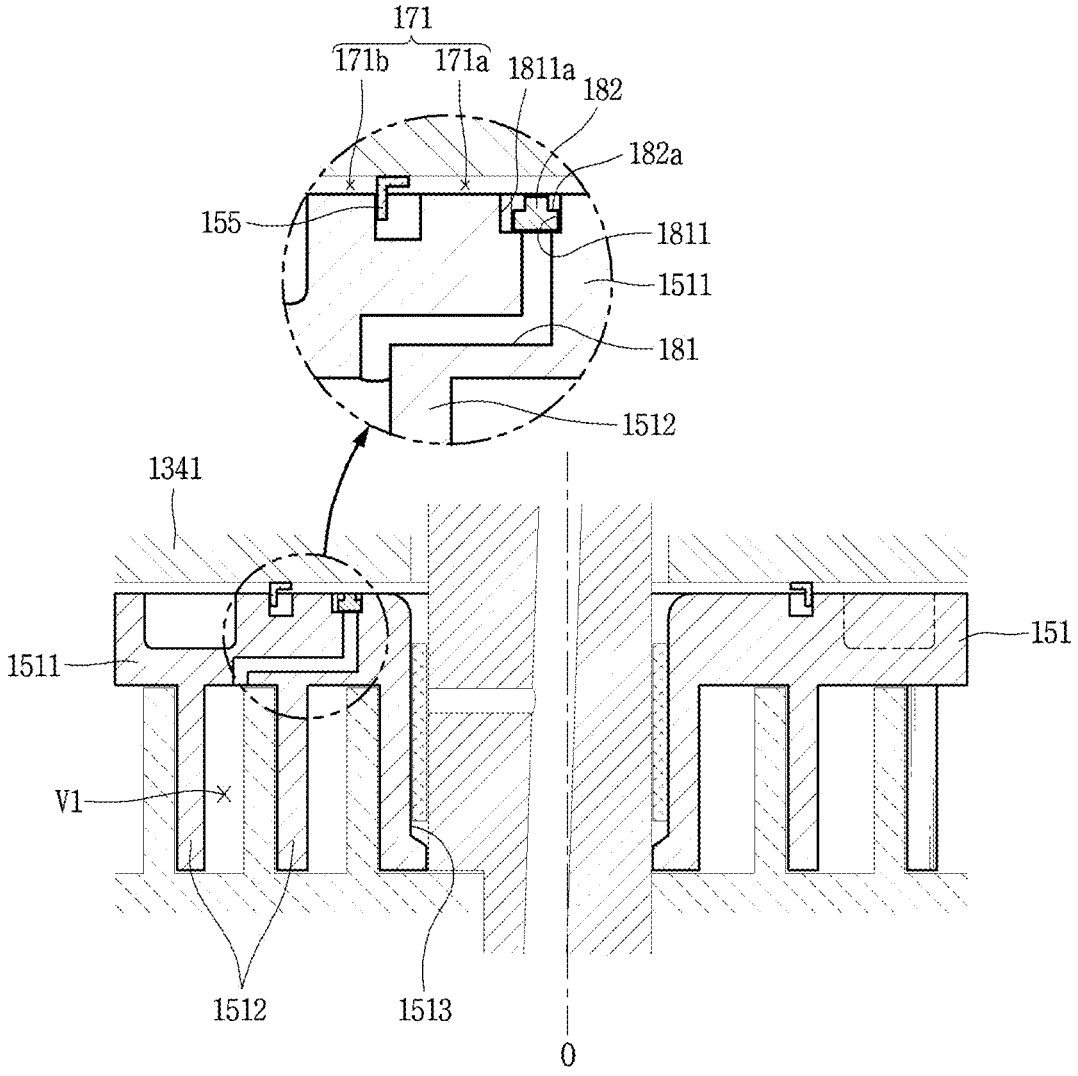
FIG. 5 is a cross-sectional view taken along the line "IX-IX" of FIG. 4.

FIG. 3 is an exploded perspective view illustrating a capacity varying apparatus in FIG. 2, FIG. 4 is an assembled planar view of FIG. 3, and FIG. 5 is a cross-sectional view taken along the line "IX-IX" of FIG. 4.

Referring back to FIG. 1, the capacity varying apparatus 180 according to the embodiment of the present disclosure is disposed between the first side surface forming the bottom surface of the main frame 130 and the first orbiting scroll 151 facing it. In other words, the capacity varying apparatus 180 may be disposed adjacent to the first back pressure chamber 171 that presses the first orbiting scroll 151 toward the first fixed scroll 141.

Specifically, the capacity varying apparatus 180 according to the embodiment includes a communication hole 181 and a first valve 182.

Referring to FIGS. 3 to 5, the communication hole 181 is disposed in the first orbiting scroll 151 such that the first compression chamber V1 and the first back pressure chamber 171 communicate with each other therethrough. For example, the communication hole 181 is formed to penetrate between the first side surface of the first orbiting end plate portion 1511 forming the intermediate pressure chamber and the second side surface forming the first back pressure chamber 171. One end of the communication hole 181 may communicate with the first compression chamber V1 at a position forming the intermediate pressure chamber and another end of the communication hole 181 may communicate with the first inner back pressure chamber 171*a* with respect to the first back pressure sealing member 155. Accordingly, during the low-speed/low-pressure ratio operation, the pressure in the first inner back pressure chamber 171*a* becomes lower than the pressure in the first compression chamber (intermediate pressure chamber) V1, so that refrigerant in the first compression chamber V1 can leak into the first inner back pressure chamber 171*a*.

An inner diameter of the communication hole 181, more precisely, an inner diameter of one end of the communication hole 181 that is open toward the first compression chamber V1, is formed smaller than a wrap thickness of the first fixed wrap 1414 facing the one end of the communication hole 181. This can suppress refrigerant in the first compression chamber V1 from leaking between the compression chambers through the communication hole 181.

A valve receiving groove 1811 may be formed in another end of the communication hole 181, more precisely, another end of the communication hole 181 that is open toward the first back pressure chamber 171, and the first valve 182, which will be described later, may be slidably inserted into the valve receiving groove 1811. The valve receiving groove 1811 may be formed to have the same inner diameter as the communication hole 181, but may alternatively be expanded to be greater than the inner diameter of the communication hole 181. Accordingly, the communication hole 181 can be smoothly open and closed by the first valve 182.

A refrigerant guide groove 1811*a* may be formed in an inner circumferential surface of the valve receiving groove 1811. For example, the refrigerant guide groove 1811*a* formed in the inner circumferential surface of the valve receiving groove 1811 may extend in a direction toward the first bearing hole 1413*a*. Accordingly, refrigerant in the first compression chamber V1 can leak more quickly into the first back pressure chamber 171 through the valve guide groove 1811.

The first valve 182 may be formed in a disc shape with a single outer diameter or may be formed in a disc shape with a plurality of outer diameters. In the embodiment according to the present disclosure, an example in which the first valve 182 has a plurality of outer diameters. For example, the first valve 182 may be formed so that a cross-sectional area of a first stage facing the main frame 130 is smaller than a cross-sectional area of a second stage facing the first orbiting scroll 151. In other words, the second stage of the first valve 182 may be formed to be larger than the inner diameter of the communication hole 181, but the first stage of the first valve 182 may be formed to be smaller than or equal to the inner diameter of the communication hole 181. Accordingly, the first valve 182 can have a suction surface 182*a* stepped along the edge of the first stage, such that a height difference is generated by a depth of the suction surface 182*a* between the first stage of the first valve 182 and the first side surface of the main frame 130 when the first valve 182 is open. Therefore, when switching to the power operation, oil in the first inner back pressure chamber 171*a* can flow to the suction surface 182*a* to press the first valve 182 in a closing direction.

Although not illustrated in the drawings, the suction surface 182*a* may be formed variously and simply. For example, the suction surface 182*a* may be formed on the first stage of the first valve 182 as a groove in the shape like '–' or '+' with a preset width.

Figure 6:
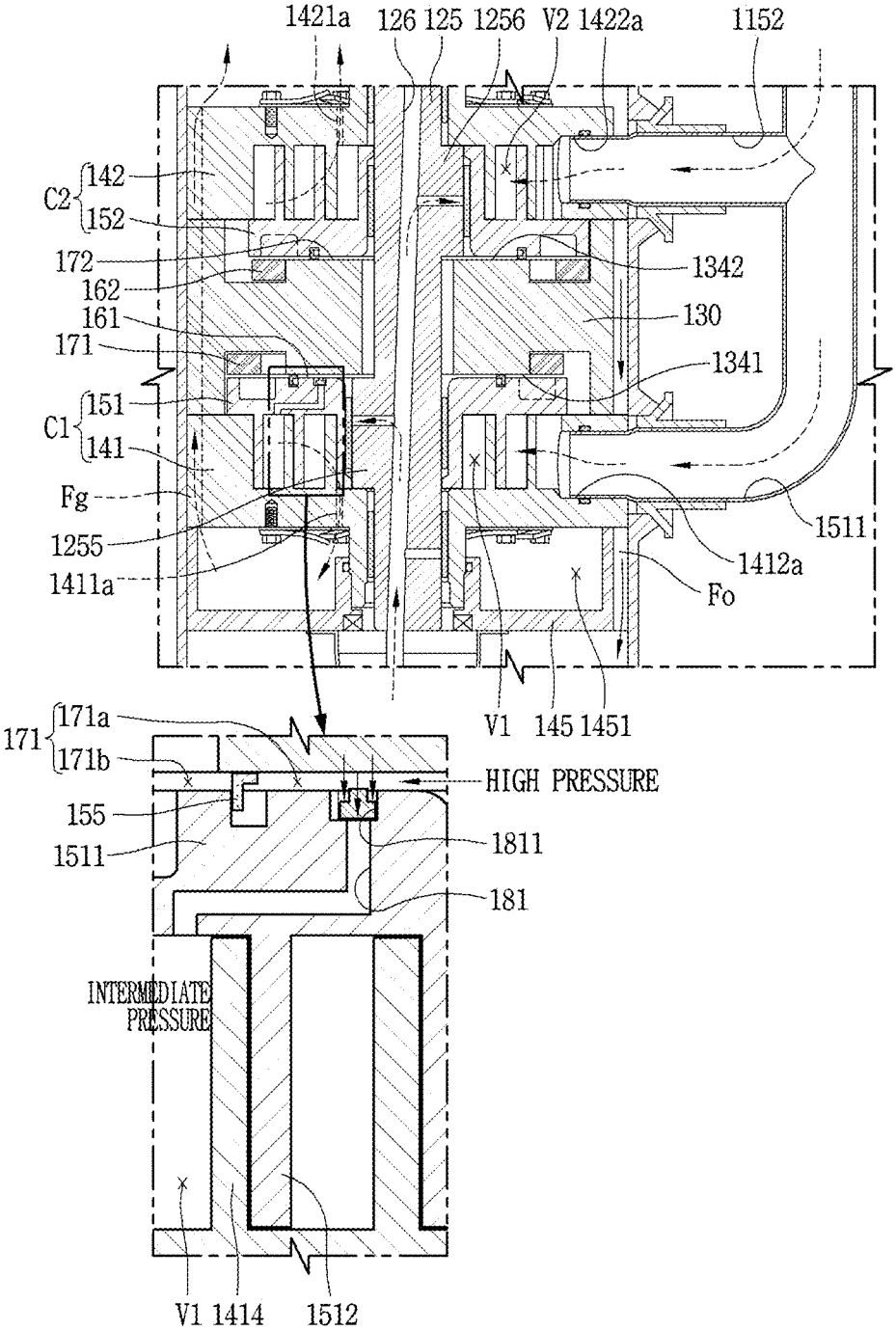
Figure 7:
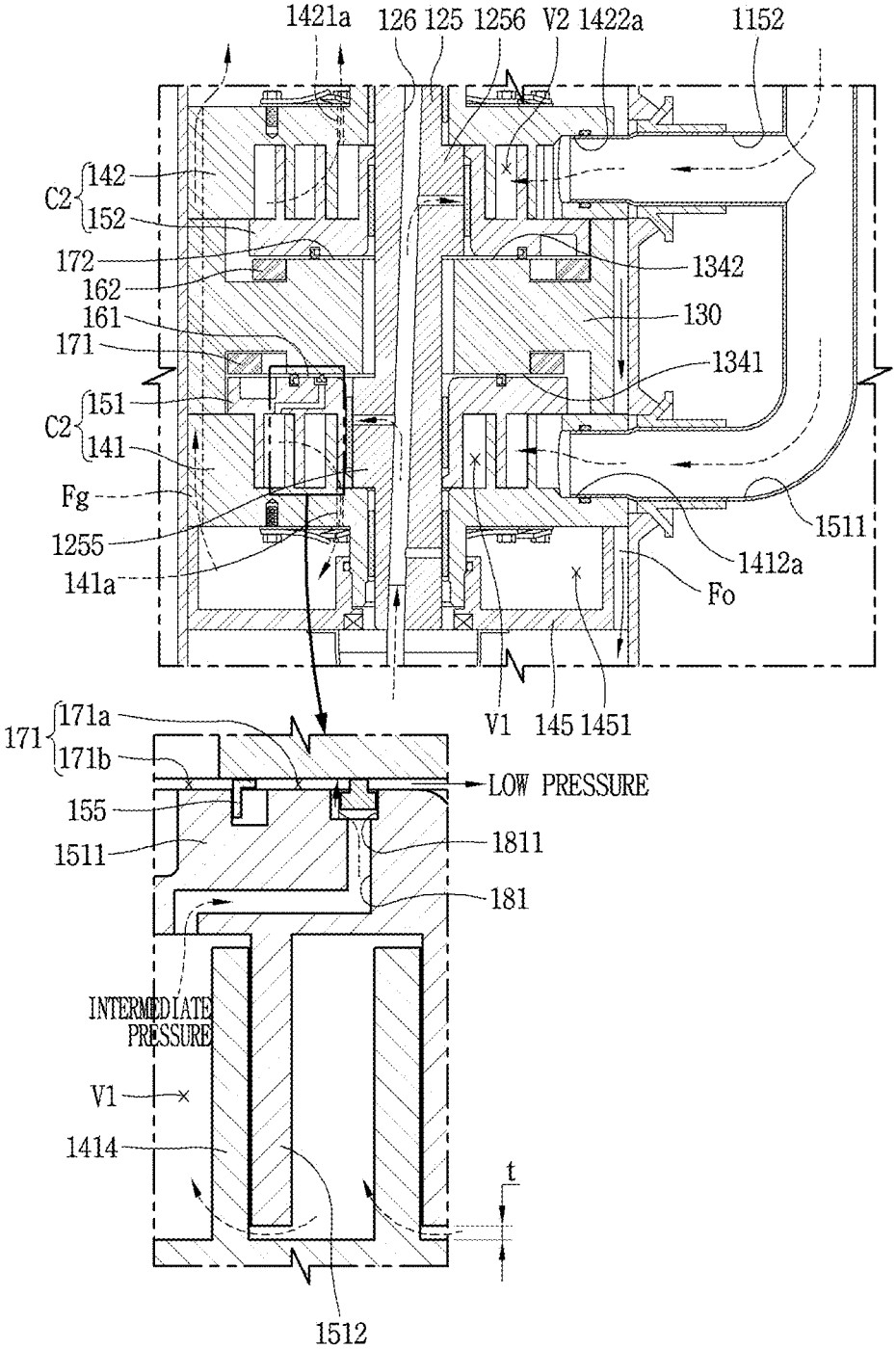

Hereinafter, operating effects of the capacity varying apparatus according to the embodiment will be described. FIGS. 6 and 7 are cross-sectional views illustrating the operations of the capacity varying apparatus in FIG. 1, wherein FIG. 6 illustrates a power operation and FIG. 7 illustrates a saving operation.

First, as illustrated in FIG. 6, during the power operation, the compressor performs a high-speed/high-pressure ratio operation, so discharge pressure is maintained to be higher than intermediate pressure. Then, the pressure of oil supplied to the first inner back pressure chamber 171*a* through the oil supply passage 126 and the first bearing hole 1413*a* forms discharge pressure higher than pressure in the first compression chamber (intermediate pressure chamber) V1.

Then, the oil in the first inner back pressure chamber 171*a* pushes the first valve 182 toward the first orbiting scroll 151, so that the first valve 182 maintains a closed state of blocking the communication hole 181.

Then, the communication hole 181 is kept blocked, thereby suppressing the refrigerant in the first compression chamber V1 from leaking into the first inner back pressure chamber 171*a*, and as a result, pressure in the first back pressure chamber 171 is maintained to be higher than the pressure in the first compression chamber V1. Then, the first orbiting scroll 151 is pushed by the back pressure of the first back pressure chamber 171 to be in close contact with the first fixed scroll 141, thereby suppressing leakage between compression chambers in the first compression chamber V1. Then, in the first compression chamber V1, refrigerant is smoothly suctioned, compressed, and discharged.

At this time, oil flowing into the second back pressure chamber 172 also forms discharge pressure, such that the second orbiting scroll 152 is pushed by the back pressure of the second back pressure chamber 172 to be in close contact with the second fixed scroll 142. Accordingly, leakage between compression chambers in the second compression chamber V2 is suppressed, and refrigerant is smoothly suctioned, compressed, and discharged in the second compression chamber V2. Therefore, the compressor can produce 100% of cooling capacity.

On the contrary, as illustrated in FIG. 7, during the saving operation, the compressor performs a low-speed/low-pressure ratio operation, so discharge pressure lower than intermediate pressure is formed. Then, the pressure of oil supplied to the first inner back pressure chamber 171*a* through the oil supply passage 126 and the first bearing hole 1413*a* forms intermediate pressure lower than pressure in the first compression chamber (intermediate pressure chamber).

Then, oil in the first inner back pressure chamber 171*a* fails to push the first valve 182 toward the first orbiting scroll 151, and the first valve 182 is even pushed toward the main frame 130 to thereby open the communication hole 181.

Then, pressure in the first back pressure chamber 171 does not form sufficient back pressure, and the first fixed scroll 141 and the first orbiting scroll 151 are spaced apart from each other by a certain gap t. As a result, leakage occurs between compression chambers in the first compression chamber V1, and simultaneously refrigerant in the first compression chamber V1 leaks into the first inner back pressure chamber 171*a*. Due to the leakage, in the first compression part C1, a kind of idling operation is performed in which refrigerant is not compressed even though it is suctioned into the first compression chamber V1.

At this time, oil flowing into the second back pressure chamber 172 also forms intermediate pressure lower than discharge pressure, but the second back pressure chamber 172 remains sealed. Accordingly, the second orbiting scroll 152 is pushed toward the second fixed scroll 142 by the back pressure of the second back pressure chamber 172, thereby suppressing leakage between compression chambers in the second compression chamber V2. Therefore, in the second compression chamber V2, refrigerant is smoothly suctioned, compressed, and discharged, and the compressor produces 50% of cooling capacity.

Although not illustrated in the drawing, the second compression part C2 may also include a capacity varying apparatus 180, similar to the first compression part C1. In this instance, by performing the idling operation of the second compression part C2 as well as the first compression part C1, not only 50% of the saving operation mode but also a complete idling operation producing 0% of the cooling capacity can be implemented in various ways.

Hereinafter, another embodiment of a capacity varying apparatus will be described.

That is, in the previous embodiment, refrigerant in the compression chamber leaks into the back pressure chamber to perform idling of the corresponding compression part, but in some cases, refrigerant may be blocked from being suctioned into the compression chamber to perform idling for the corresponding compression part.

Figure 8:
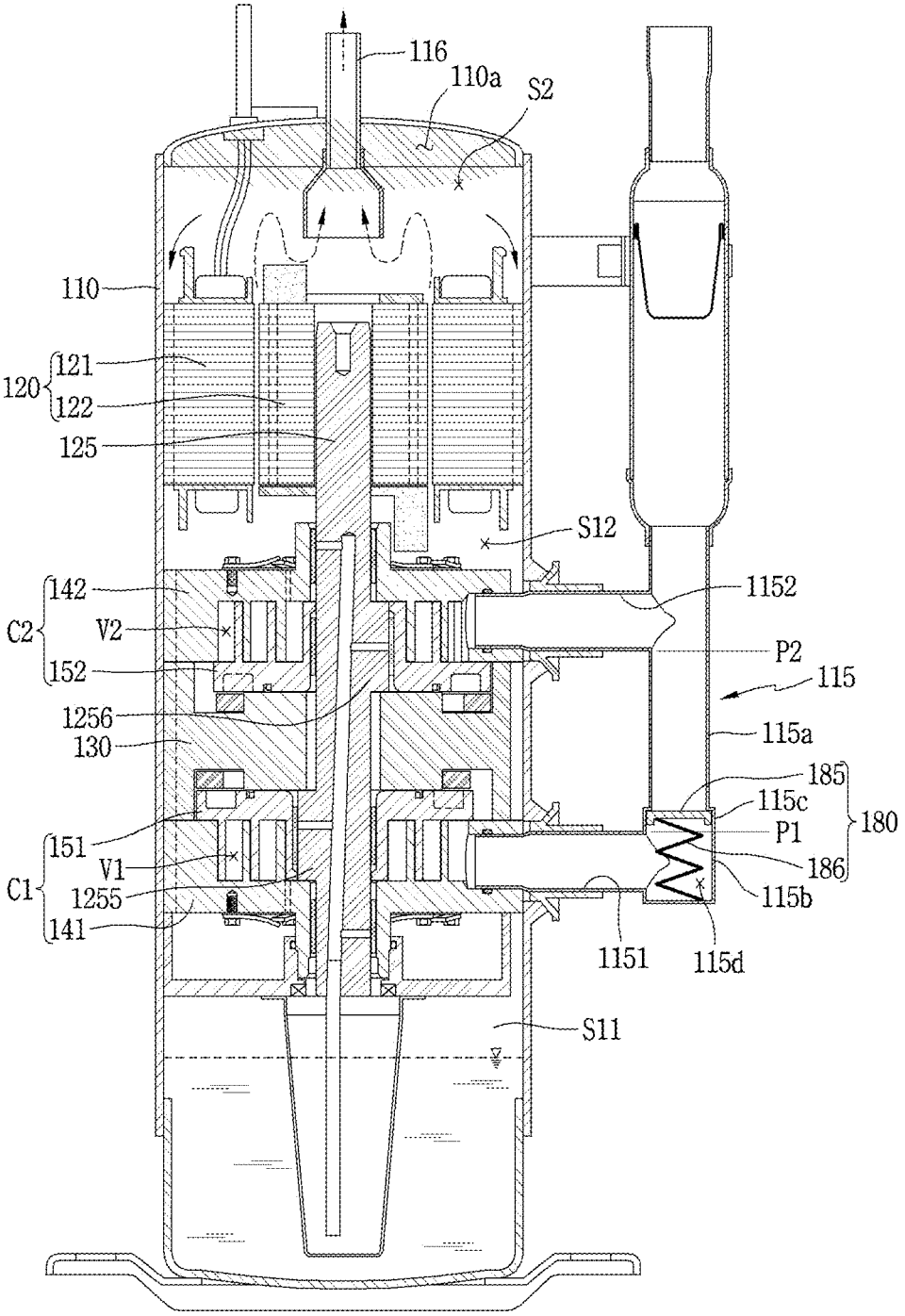
FIG. 8 is a longitudinal sectional view of a scroll compressor which includes a capacity varying apparatus according to another embodiment.

FIG. 8 is a longitudinal sectional view of a scroll compressor which includes a capacity varying apparatus according to another embodiment.

Referring to FIG. 8, the basic configuration of a scroll compressor according to this embodiment and operating effects thereof are similar to those in the previous embodiment. For example, the scroll compressor according to this embodiment includes the drive motor 120 disposed inside the casing 110. The rotation shaft 125 of the drive motor 120 includes the first eccentric portion 1255 and the second eccentric portion 1256. The first orbiting scroll 151 is coupled to the first eccentric portion 1255 to form the first compression part C1 having the first compression chamber V1 together with the first fixed scroll 141, and the second orbiting scroll 152 is coupled to the second eccentric portion 1256 to form the second compression part C2 having the second compression chamber V2 together with the second fixed scroll 142. The main frame 130 is disposed between the first compression part C1 and the second compression part C2, thereby separating the first compression part C1 and the second compression part C2. Accordingly, the refrigerant suctioned into the first compression part C1 through the first suction pipe 1151 of the refrigerant suction pipe 115 is compressed in the first compression part C1 and discharged into the inner space 110*a* of the casing 110, and refrigerant suctioned into the second compression part C2 through the second suction pipe 1152 of the refrigerant suction pipe 115 is compressed in the second compression part C2 and discharged into the inner space 110*a* of the casing 110.

However, in this embodiment, a second valve 185 may be installed in the first suction pipe 1151 and/or the second suction pipe 1152 so that the first suction pipe 1151 and/or the second suction pipe 1152 can be selectively open and closed depending on the operating conditions of the compressor.

Specifically, the refrigerant suction pipe 115 may be formed with a single inner diameter, but may also be formed in a multi-stage pipe shape with a plurality of inner diameters. For example, the refrigerant suction pipe 115 may include a small-diameter portion 115*a* and a large-diameter portion 115*b*. The second suction pipe 1152 may be connected to the small-diameter portion 115*a*, and the first suction pipe 1151 may be connected to the large-diameter portion 115*b*. In other words, the upstream side of the refrigerant suction pipe 115 may be formed as the small-diameter portion 115*a*, and the downstream side of the refrigerant suction pipe 115 may be formed as the large-diameter portion 115*b*. Accordingly, a stepped valve seat surface 115*c* may be formed between the small-diameter portion 115*a* and the large-diameter portion 115*b*.

The second valve 185 may be formed as a plate-shaped valve or a piston valve and may be slidably inserted into a valve space 115*d* defined between the first suction pipe 1151 and the second refrigerant pipe 1152, that is, between a first position P1 where the first suction pipe 1151 is connected and a second position P2 where the second suction pipe 1152 is connected. Accordingly, the second valve 185 is attached to or detached from the valve seat surface 115*c* while sliding between the first position P1 and the second position P2 in the valve space 115*d*, which forms an inner space of the large-diameter portion 115*b*, due to the pressure change of refrigerant suctioned into the refrigerant suction pipe 115. Accordingly, the refrigerant can be suctioned into the first compression chamber V1 or blocked from flowing into the first compression chamber V1.

A valve spring 186 that elastically supports the second valve 185 may be disposed on a back pressure surface of the second valve 185, that is, on one side surface of the second valve 185 to which the first refrigerant pipe 1151 belongs. Accordingly, the second valve 185 can move to the closed position more quickly during the low-speed/low-pressure ratio operation.

Figure 9:
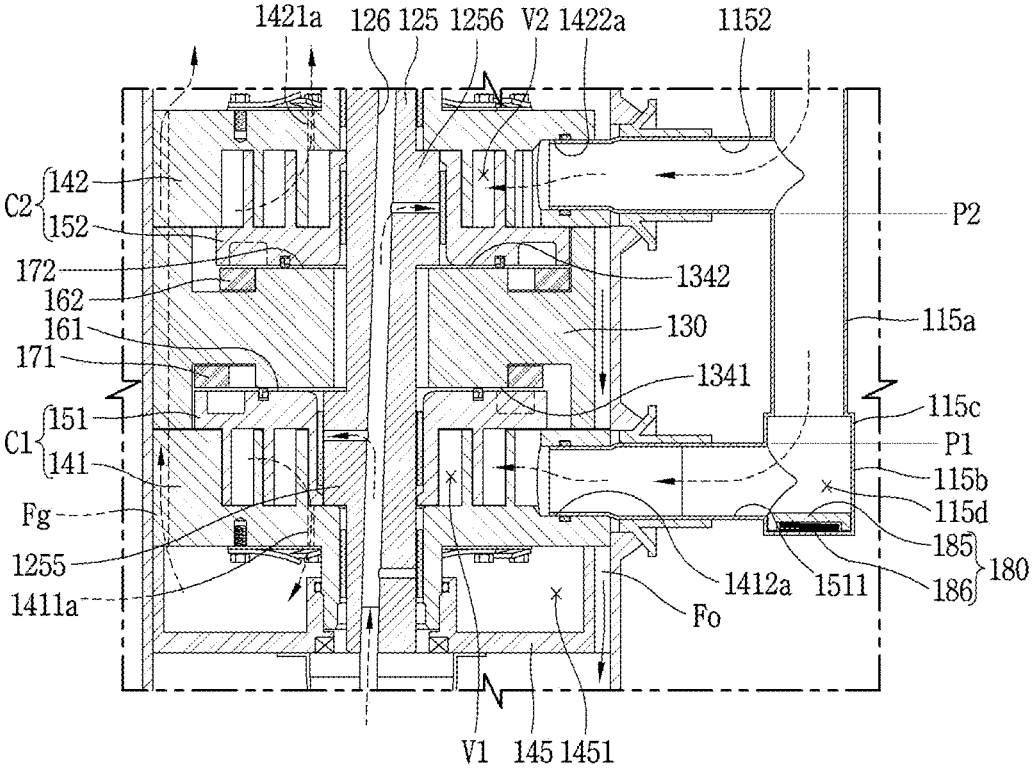
Figure 10:
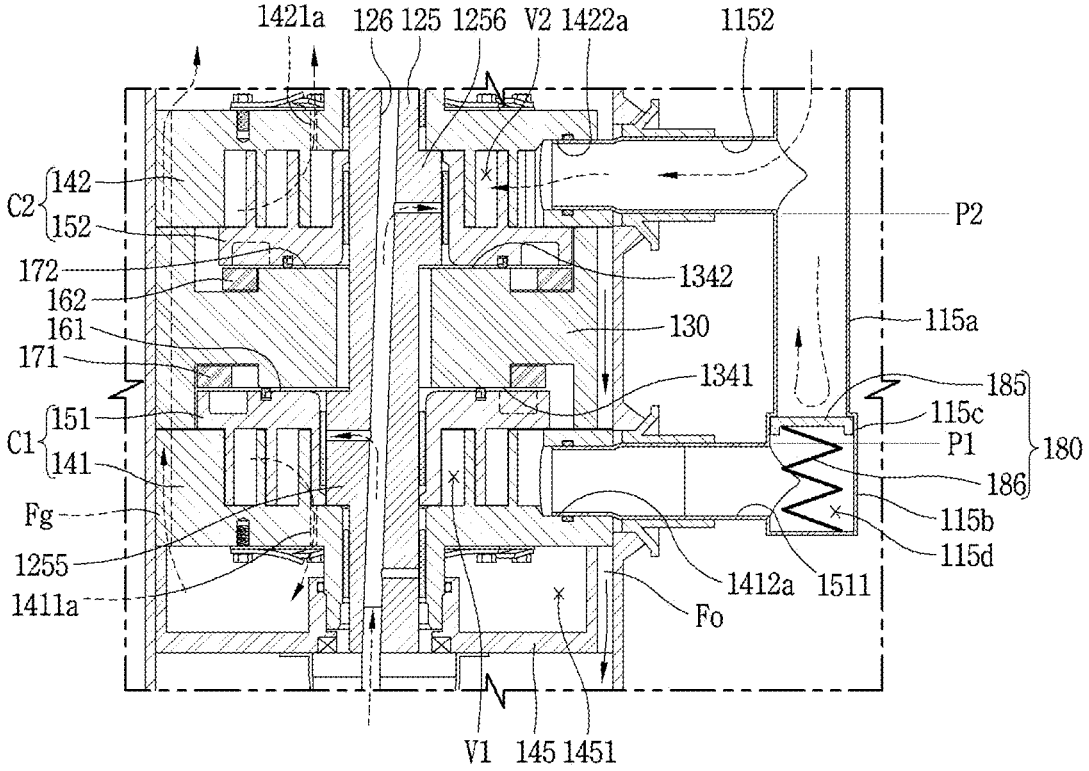

Hereinafter, operating effects of the capacity varying apparatus in the scroll compressor according to the embodiment will be described. FIGS. 9 and 10 are cross-sectional views illustrating the operations of the capacity varying apparatus in FIG. 8, wherein FIG. 9 illustrates a power operation and FIG. 10 illustrates a saving operation.

First, as illustrated in FIG. 9, during the power operation of the compressor, a high-speed/high-pressure ratio operation is performed, so the second valve 185 endures elastic force of the valve spring 186 and moves in the opening direction. Then, the first suction pipe 1151 is open, such that refrigerant is smoothly suctioned into the first compression chamber V1 through the first suction pipe 1151, compressed, and then discharged.

At this time, the second suction pipe 1152 which is located upstream relative to the first suction pipe 1151 is also open, so that refrigerant is smoothly suctioned into the second compression chamber V2, compressed, and then discharged. Therefore, the compressor can produce 100% of a cooling capacity.

On the other hand, as illustrated in FIG. 10, during the saving operation of the compressor, a low-speed/low-pressure ratio operation is performed, and the second valve 185 thus moves in the closing direction by the elastic force of the valve spring 186. Then, a space between the first suction pipe 1151 and the second suction pipe 1152 is blocked, so that refrigerant does not flow into the first suction pipe 1151. As the refrigerant is not suctioned into the first compression chamber V1, the first compression part C1 performs a kind of idling operation.

At this time, the second suction pipe 1152 which is located upstream relative to the first suction pipe 1151 (precisely, the valve seat surface) is open, so that the refrigerant is smoothly suctioned into the second compression chamber V2, compressed, and then discharged. Therefore, the compressor can produce 50% of a cooling capacity.

Hereinafter, still another embodiment of a capacity varying apparatus will be described.

That is, in the previous embodiment, the second valve blocks the refrigerant suction pipe by the elastic force of the valve spring, but in some cases, the refrigerant suction pipe may be blocked by using back pressure against the orbiting scroll.

Figure 11:
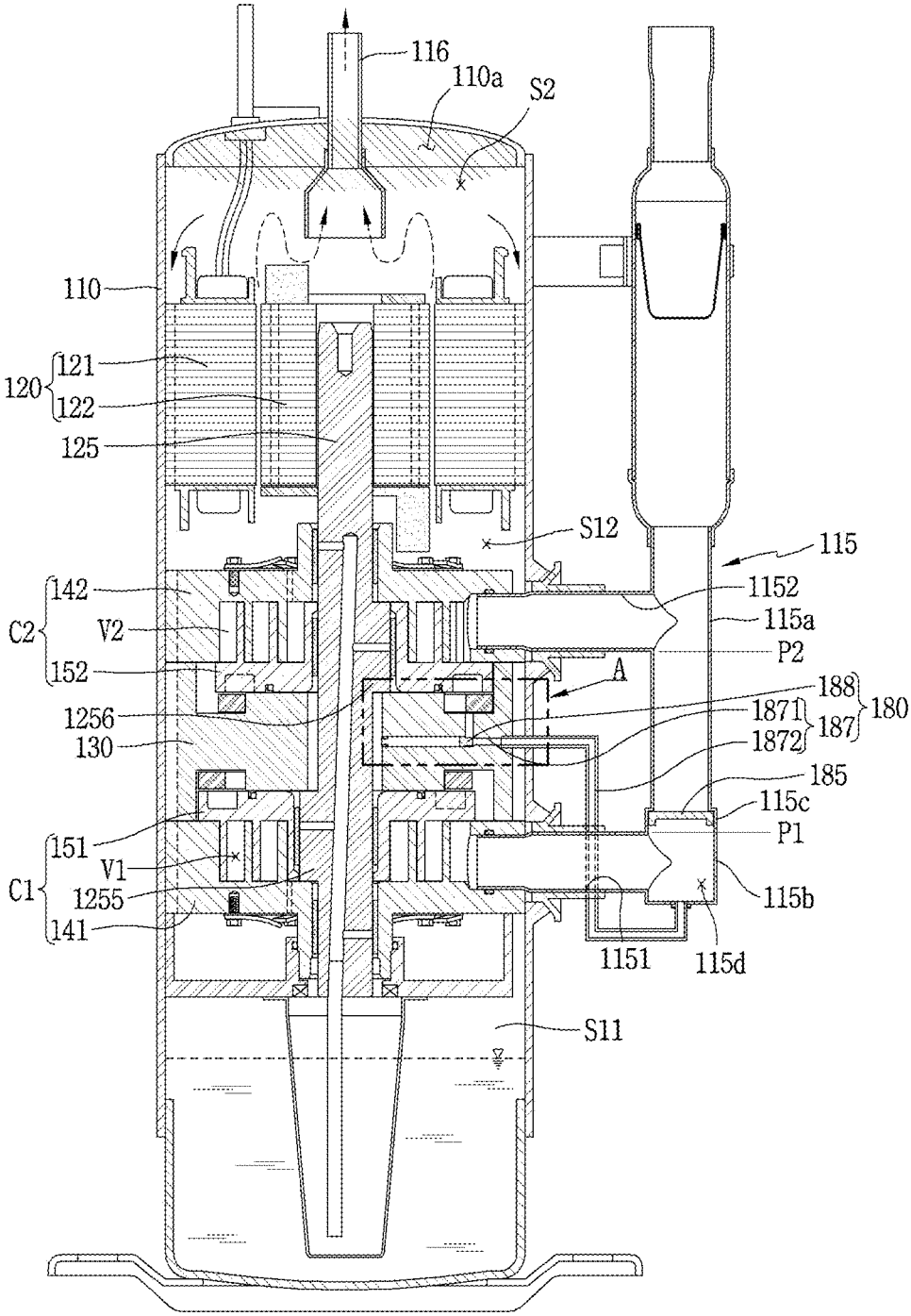
FIG. 11 is a longitudinal sectional view of a scroll compressor which includes a capacity varying apparatus according to still another embodiment.
Figure 12:
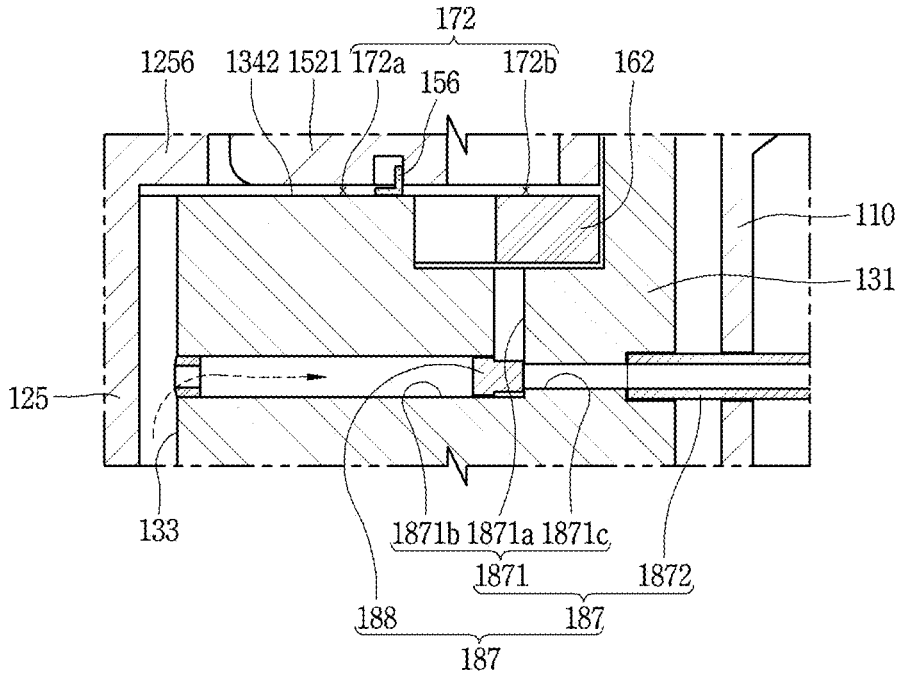
FIG. 12 is an enlarged sectional view of part "A" in FIG. 11.

FIG. 11 is a longitudinal sectional view of a scroll compressor which includes a capacity varying apparatus according to still another embodiment, and FIG. 12 is an enlarged sectional view of part "A" in FIG. 11.

Referring to FIG. 11, the basic configuration of a scroll compressor according to this embodiment and operating effects thereof are similar to those in the previous embodiment of FIG. 8. In other words, in this embodiment as well, the second valve 185 is provided to selectively open and close the first suction pipe 1151 connected to the first compression part C1 and/or the second suction pipe 1152 connected to the second compression part C2 to operate the corresponding compression part normally or in an idle mode depending on the operating conditions of the compressor. However, in this embodiment, the second valve 185 may be open and closed using back pressure of the second compression part C2 or the first compression part C1.

For example, in this embodiment, a pressurization passage 187 is formed between the second back pressure chamber 172 and the refrigerant suction pipe 115, and one end of the pressurization passage 187 communicates with the second back pressure chamber (e.g., second outer back pressure chamber) 172 that forms intermediate pressure, while another end of the pressurization passage 187 communicates with the valve space 115*d* of the refrigerant suction pipe 115 formed by the back pressure surface of the second valve 185. Accordingly, refrigerant in the second back pressure chamber 172 pressurizes the back pressure surface of the second valve 185 toward the second position P2.

Referring to FIG. 12, the pressurization passage 187 may include a pressurization hole 1871 formed through the main frame 130 and a connection pipe 1872 connecting the pressurization hole 1871 to the refrigerant suction pipe 115.

The pressurization hole 1871 may include a first hole 1871*a*, a second hole 1871*b*, and a third hole 1871*c*. One end of the first hole 1871*a* is connected to the second back pressure chamber (e.g., second outer back pressure chamber) 172, and one end of the second hole 1871*b* is connected to another end of the first hole 1871*a*. Another end of the second hole 1871*b* is connected to the shaft receiving portion 133 of the main frame 130, and one end of the third hole 1871*c* is connected to a contact point between the first hole 1871*a* and the second hole 1871*b* where the another end of the first hole 1871*a* and the one end of the second hole 1871*b* meet each other. The another end of the third hole 1871*c* is connected to the connection pipe 1872.

In other words, the pressurization hole 1871 is formed in a roughly T-like shape with three branches branched out to both sides from the another end of the first hole 1871*a*, and more precisely, the first hole 1871*a* communicates with a circumferential surface of the second hole 1871*b*, and the third hole 1871*c* is connected to the end portion of the second hole 1871*b*.

An inner diameter of the first hole 1871*a* is equal to or smaller than an inner diameter of the second hole 1871*b*, and the inner diameter of the second hole 1871*b* is greater than an inner diameter of the third hole 1871*c*. Accordingly, a step surface is formed between the second hole 1871*b* and the third hole 1871*c*, and serves as a type of valve seat surface.

The connection pipe 1872 is formed as a pipe with an inner diameter much smaller than that of the refrigerant suction pipe 115 and is connected between the pressurization hole 1871 and the valve space 115*d* of the refrigerant suction pipe 115. For example, one end of the connection pipe 1872 is connected to another end of the pressurization hole 1871, that is, the another end of the third hole 1871*c*, and another end of the connection pipe 1872 is inserted through the casing 110 to be connected to the refrigerant suction pipe 115.

In an example, the another end of the connection pipe 1872 may be connected to a side surface of the valve space 115*d* to be lower than the first suction pipe 1151, more preferably, to a side surface on an opening direction side of the second valve 185. Accordingly, when the compressor operates at a low-speed/low-pressure ratio, oil in the second back pressure chamber 172 can be quickly supplied to the side surface in the opening direction of the second valve 185 through the pressurization passage 187, thereby quickly blocking the first suction pipe 1151.

Meanwhile, a third valve 188 may be disposed at a contact point among the first hole 1871*a*, the second hole 1871*b*, and the third hole 1871*c*. The third valve 188 can allow the movement of refrigerant from the second back pressure chamber 172 to the valve space 115*d*, while blocking the movement of refrigerant from the valve space 115*d* to the second back pressure chamber 172.

Specifically, the third valve 188 may be configured as a small piston valve to be slidably inserted into the second hole 1871*b*. Even in an example, the third valve 188 may also be formed in a cylindrical shape with a single outer diameter that outer diameters on both ends are the same, but in other examples, like the first valve 182 in the embodiment of FIG. 3, the third valve 188 may be formed in a T-like cross-sectional shape that an outer diameter toward the second hole 1871*b* is greater than an outer diameter toward the third hole 1871*c*.

For example, a first stage of the third valve 188 may be formed to have almost the same inner diameter as the second hole 1871*b*, and a second stage of the third valve 188 may be formed to be smaller than an outer diameter of the first stage and greater than the inner diameter of the third hole 1871*c*. Accordingly, the third valve 188 can be quickly open and closed depending on the operating mode of the compressor.

Figure 13:
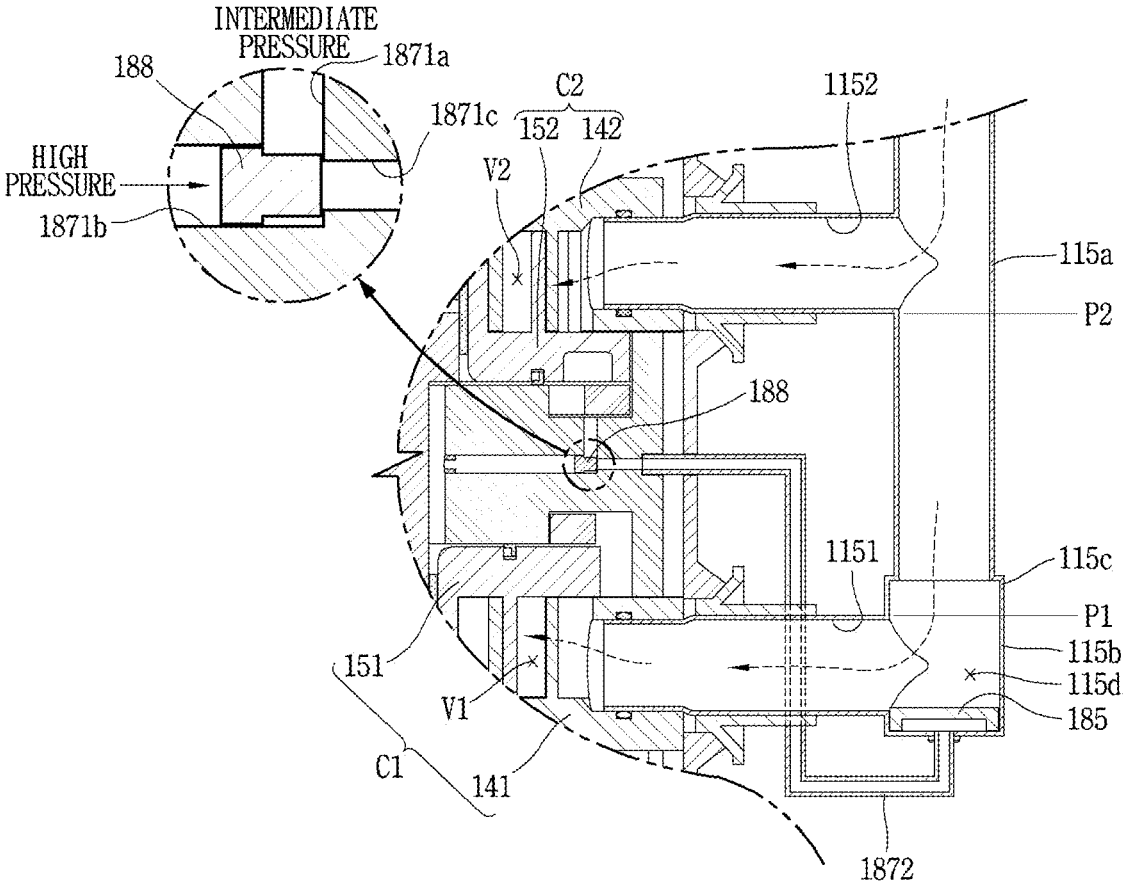
Figure 14:
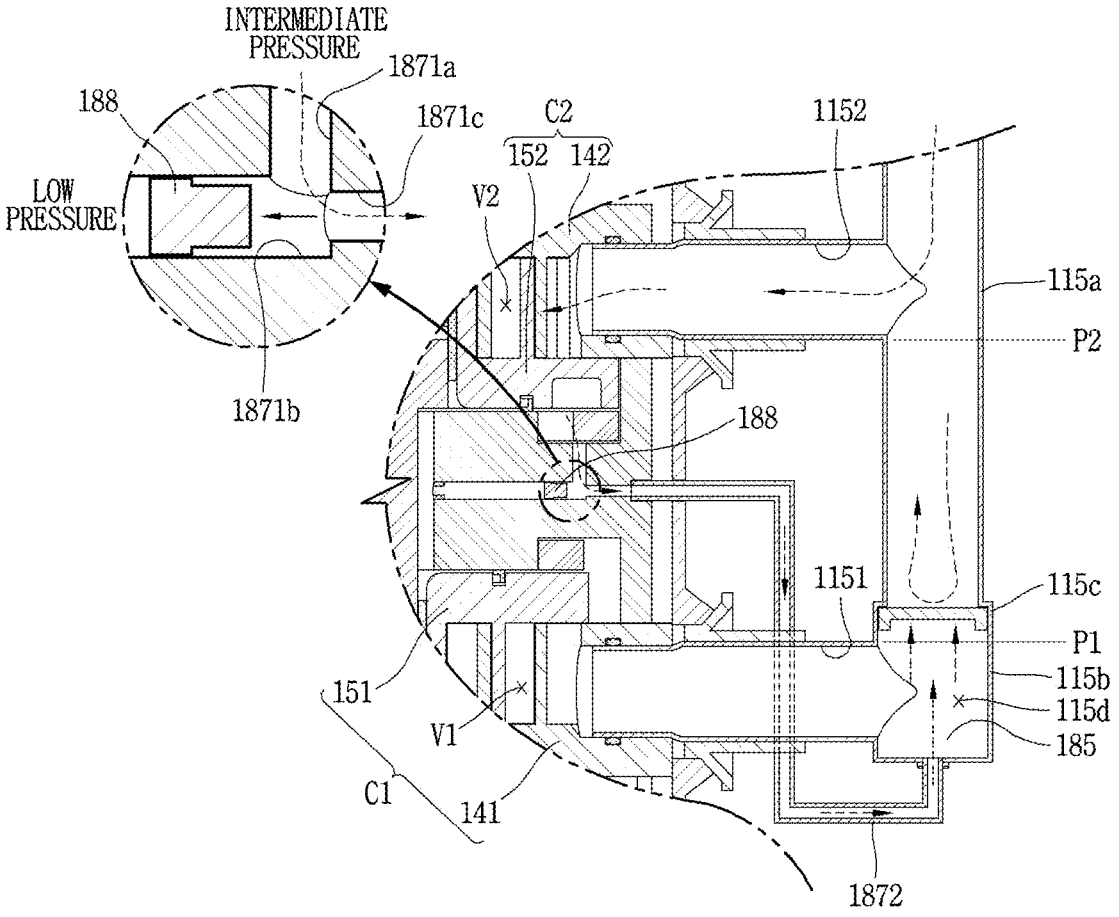

Hereinafter, operating effects of the capacity varying apparatus in the scroll compressor according to the embodiment will be described. FIGS. 13 and 14 are cross-sectional views illustrating the operations of the capacity varying apparatus in FIG. 11, wherein FIG. 13 illustrates a power operation and FIG. 14 illustrates a saving operation.

First, as illustrated in FIG. 13, during the power operation, the compressor operates at a high-speed/high-pressure ratio, so that pressure adjacent to the second hole 1871*b* forms discharge pressure higher than pressure in the second outer back pressure chamber 172*b*. Then, the third valve 188 is pushed toward the third hole 1871*c* to block a space between the first hole 1871*a* and the third hole 1871*c*. Then, pressure in the valve space 115*d* in which the second valve 185 is accommodated is lowered, and the second valve 185 moves in the opening direction by resisting the pressure of the valve space 115*d*. Then, the first suction pipe 1151 is open, such that refrigerant is smoothly suctioned into the first compression chamber V1 through the first suction pipe 1151, compressed, and then discharged.

At this time, the second suction pipe 1152 located upstream from the first suction pipe 1151 is also open, so that the refrigerant is smoothly suctioned into the second compression chamber V2, compressed, and then discharged. Therefore, the compressor can produce 100% of cooling capacity.

On the contrary, as illustrated in FIG. 14, during the saving operation, the compressor operates at a low-speed/low-pressure ratio, so that pressure near the second hole 1871*b* forms intermediate pressure lower than pressure in the second outer back pressure chamber 172*b*. Then, the third valve 188 is pushed toward the second hole 1871*b*, opposite the third hole 1871*c*, by intermediate pressure oil introduced through the first hole 1871*a*. Then, when the space between the first hole 1871*a* and the third hole 1871*c* is open, oil in the second outer back pressure chamber 172*b* moves toward the valve space 115*d* of the refrigerant suction pipe 115 through the third hole 1871*c* and the connection pipe 1872. Then, the second valve 185 moves in the closing direction by the pressure of the valve space 115*d*. Then, a space between the first suction pipe 1151 and the second suction pipe 1152 is blocked, so that refrigerant does not flow into the first suction pipe 1151. As the refrigerant is not suctioned into the first compression chamber V1, the first compression part C1 performs a kind of idling operation.

At this time, the second suction pipe 1152 which is located upstream relative to the first suction pipe 1151 (precisely, the valve seat surface) is open, so that the refrigerant is smoothly suctioned into the second compression chamber V2, compressed, and then discharged. Therefore, the compressor can produce 50% of a cooling capacity.

Although not illustrated in the drawing, even in this embodiment, an elastic member such as the valve spring 186 may be additionally disposed on the back pressure surface side of the second valve 185. In this case, the second valve 185 can move more quickly in the closing direction by elastic force of the valve spring 186 in addition to the pressure of the valve space 115*d*.

Meanwhile, in the previous embodiment, the refrigerant discharged from the first compression part C1 to the discharge space 1451 of the discharge cover 145 moves to the discharge space S12 of the casing 110 through the refrigerant discharge passage Fg provided in the first compression part C1, the main frame 130, and the second compression part C2, and then passes through the drive motor 120 to move to the upper space S2. However, in some cases, a refrigerant guide pipe (not illustrated) may be disposed on the outside of the casing 110 so that the refrigerant discharged to the discharge space 1451 of the discharge cover 145 can be guided to the refrigerant guide pipe provided outside the casing 110 to move to the upper space S2 of the casing 110. In this case, since a refrigerant discharge passage is not formed in the outer circumferential surface of the first compression part C1 and the outer circumferential surface of the second compression part C2 forming the compression part C, the outer diameter of the compression chamber can be widened to that extent, thereby increasing the volume of the compression chamber. Even in this case, the basic structure of the compressor and the basic structure of the capacity varying apparatus described above can be formed in the same way.

The invention claimed is:

1. A scroll compressor, comprising:

a casing;

a rotation shaft that comprises a first eccentric portion and a second eccentric portion which are spaced apart from each other in an axial direction;

a first compression part that is coupled to the first eccentric portion of the rotation shaft to form a first compression chamber;

a second compression part that is disposed on one axial side of the first compression part and coupled to the second eccentric portion of the rotation shaft to form a second compression chamber; and a main frame that comprises a shaft receiving portion disposed between the first compression part and the second compression part such that the rotation shaft penetrates therethrough, wherein at least one of the first compression part or the second compression part comprises a capacity varying part configured to idle the corresponding compression part by inducing refrigerant leakage from a compression chamber or block refrigerant suction into the corresponding compression chamber, wherein the first compression part comprises a first orbiting scroll configured to orbitally move while being axially supported with a first back pressure chamber defined together with a first side surface of the main frame, and a first fixed scroll engaged with the first orbiting scroll to form the first compression chamber, wherein the second compression part comprises a second orbiting scroll configured to orbitally move while being axially supported with a second back pressure chamber defined together with a second side surface of the main frame, and a second fixed scroll engaged with the second orbiting scroll to form the second compression chamber, wherein the capacity varying part comprises:

a communication hole disposed in the first orbiting scroll such that the first compression chamber and the first back pressure chamber communicate with each other; and a first valve disposed to open and close the communication hole to allow refrigerant movement from the first compression chamber to the first back pressure chamber while blocking refrigerant movement from the first back pressure chamber to the first compression chamber, and wherein the first valve is formed such that a cross-section on a side toward the main frame is smaller than a cross-section on a side toward the first orbiting scroll.

2. The scroll compressor of claim 1, wherein a first back pressure sealing member is disposed between the first orbiting scroll and the first side surface of the main frame facing the first orbiting scroll to divide the first back pressure chamber into a first inner back pressure chamber and a first outer back pressure chamber, and wherein the communication hole communicates with the first inner back pressure chamber.

3. The scroll compressor of claim 2, wherein the communication hole comprises a valve receiving groove formed in an end portion thereof facing the main frame, and wherein the first valve is slidably inserted into the valve receiving groove to open and close the communication hole.

4. The scroll compressor of claim 3, wherein a refrigerant guide groove is formed by extending radially from an inner circumferential surface of the valve receiving groove, and wherein the refrigerant guide groove extends in a direction toward a center of the rotation shaft.

5. The scroll compressor of claim 1, wherein the first eccentric portion and the second eccentric portion are formed so that a center of the first eccentric portion and a center of the second eccentric portion are located at different rotational angles in the axial direction.

6. A scroll compressor, comprising:

a casing;

a rotation shaft that comprises a first eccentric portion and a second eccentric portion which are spaced apart from each other in an axial direction;

a first compression part that is coupled to the first eccentric portion of the rotation shaft to form a first compression chamber;

a second compression part that is disposed on one axial side of the first compression part and coupled to the second eccentric portion of the rotation shaft to form a second compression chamber; and a main frame that comprises a shaft receiving portion disposed between the first compression part and the second compression part such that the rotation shaft penetrates therethrough, wherein at least one of the first compression part or the second compression part comprises a capacity varying part configured to idle the corresponding compression part by inducing refrigerant leakage from a compression chamber or block refrigerant suction into the corresponding compression chamber, wherein a first suction port is formed in the first compression part, and a second suction port is formed in the second compression part, wherein a first suction pipe is connected to the first suction port, and a second suction pipe separated from the first suction pipe is connected to the second suction port, and wherein the capacity varying part comprises a second valve configured to selectively open and close the first suction pipe or the second suction pipe, wherein a refrigerant suction pipe is disposed outside the casing, wherein the first suction pipe is connected to a first position of the refrigerant suction pipe, wherein the second suction pipe is connected to a second position of the refrigerant suction pipe, wherein the second valve is disposed in the refrigerant suction pipe to open and close the refrigerant suction pipe, and the second valve is disposed between the first position and the second position, wherein the refrigerant suction pipe comprises a valve seat surface between the first position and the second position, and wherein the second valve is slidably inserted along the refrigerant suction pipe to be attached to and detached from the valve seat surface.

7. The scroll compressor of claim 6, wherein an elastic member is disposed on one side surface of the second valve to support the second valve in a direction toward the valve seat surface.

8. The scroll compressor of claim 6, wherein the first compression part comprises a first orbiting scroll configured to orbitally move while being axially supported with a first back pressure chamber defined together with a first side surface of the main frame, and a first fixed scroll engaged with the first orbiting scroll to form the first compression chamber, wherein the second compression part comprises a first orbiting scroll configured to orbitally move while being axially supported with a second back pressure chamber defined together with a second side surface of the main frame, and a second fixed scroll engaged with the second orbiting scroll to form the second compression chamber, and wherein a pressurization passage is disposed between the second back pressure chamber and the refrigerant suction pipe, to guide refrigerant in the second back pressure chamber toward a valve space defined by a back pressure surface of the second valve, such that the second valve is pressurized toward the second position.

9. The scroll compressor of claim 8, wherein the pressurization passage comprises:

a pressurization hole formed through the main frame; and a connection pipe having a first end connected to the pressurization hole, and a second end inserted through the casing to be connected to the refrigerant suction pipe, and wherein a third valve is disposed in the pressurization hole to allow refrigerant movement from the second back pressure chamber to the valve space while blocking refrigerant movement from the valve space to the second back pressure chamber.

10. The scroll compressor of claim 9, wherein a second back pressure sealing member is disposed between the second orbiting scroll and the second side surface of the main frame facing the second orbiting scroll to divide the second back pressure chamber into a second inner back pressure chamber and a second outer back pressure chamber, and wherein the pressurization hole communicates with the second outer back pressure chamber.

11. The scroll compressor of claim 10, wherein the pressurization hole comprises:

a first hole connected to the second outer back pressure chamber;

a second hole having a first end connected to the first hole, and a second end connected to the shaft receiving portion of the main frame; and a third hole having a first end connected to a contact point between the first hole and the second hole, and a second end connected to the connection pipe, and wherein the third valve is slidable in the second hole to open and close a portion between the first hole and the third hole by a pressure difference between the first hole and the second hole.

* * * * *